US010731915B2

(12) United States Patent
Gillette et al.

(10) Patent No.: US 10,731,915 B2
(45) Date of Patent: Aug. 4, 2020

(54) SELF-CONTAINED PANTRY BOX SYSTEM FOR INSERTION INTO AN APPLIANCE

(71) Applicant: WHIRLPOOL CORPORATION, Benton Harbor, MI (US)

(72) Inventors: Thomas A. Gillette, Shelby Township, MI (US); Duane M. Kobos, Laporte, IN (US); Todd Tunzi, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 175 days.

(21) Appl. No.: 15/862,150

(22) Filed: Jan. 4, 2018

(65) Prior Publication Data

US 2018/0128541 A1 May 10, 2018

Related U.S. Application Data

(63) Continuation of application No. 14/644,421, filed on Mar. 11, 2015, now Pat. No. 9,897,370.

(51) Int. Cl.
*F25B 5/00* (2006.01)
*F25D 25/02* (2006.01)

(52) U.S. Cl.
CPC ..... *F25D 25/025* (2013.01); *F25B 5/00* (2013.01); *F25C 2400/10* (2013.01); *F25D 2317/061* (2013.01)

(58) Field of Classification Search
CPC ..... F25D 2317/061; F25D 25/025
See application file for complete search history.

(56) References Cited

U.S. PATENT DOCUMENTS 948,541 A 2/1910 Coleman
1,275,511 A 8/1918 Welch
(Continued)

FOREIGN PATENT DOCUMENTS

CA 626838 A 5/1961
CA 1320631 7/1993
(Continued)

OTHER PUBLICATIONS

Machine Translation of JPO 2010-43823 to Kurita; eSpacenet; description (Year: 2010).*
(Continued)

*Primary Examiner* — Filip Zec
(74) *Attorney, Agent, or Firm* — Price Heneveld LLP

(57) ABSTRACT

A pantry box system for a refrigerating appliance includes a pantry mullion having an interstitial space defined therein, a pantry wall extending perpendicularly from the pantry mullion, a base positioned substantially parallel with the pantry mullion. The pantry mullion, pantry wall and base define an insertable pantry compartment having an internal pantry volume. A pantry drawer is in operable communication with the internal pantry volume, and is operable through a drawer aperture defined in the pantry wall between open and closed positions. The pantry drawer includes an exterior drawer panel that conceals the drawer aperture when the at least one pantry drawer in in the closed position. A pantry box cooling system is configured to deliver cooling to the insertable pantry compartment from an external location, wherein the pantry box cooling system includes a control that independently controls a pantry temperature of the insertable pantry compartment.

12 Claims, 11 Drawing Sheets

(56) References Cited

U.S. PATENT DOCUMENTS 1,849,369 A 3/1932 Frost
1,921,576 A 8/1933 Muffly
2,108,212 A 2/1938 Schellens
2,128,336 A 8/1938 Torstensson
2,164,143 A 6/1939 Munters
2,191,659 A 2/1940 Hintze
2,318,744 A 5/1943 Brown
2,356,827 A 8/1944 Coss et al.
2,432,042 A 12/1947 Richard
2,439,602 A 4/1948 Heritage
2,439,603 A 4/1948 Heritage
2,451,884 A 10/1948 Stelzer
2,538,780 A 1/1951 Hazard
2,559,356 A 7/1951 Hedges
2,729,863 A 1/1956 Kurtz
2,768,046 A 10/1956 Evans
2,817,123 A 12/1957 Jacobs
2,942,438 A 6/1960 Schmeling
2,985,075 A 5/1961 Knutsson-Hall
3,075,366 A * 1/1963 Jung ..... F25D 17/065 62/382
3,086,830 A 4/1963 Malia
3,125,388 A 3/1964 Constantini et al.
3,137,900 A 6/1964 Carbary
3,218,111 A 11/1965 Steiner
3,258,883 A 7/1966 Companaro et al.
3,290,893 A 12/1966 Haldopoulos
3,338,451 A 8/1967 Kesling
3,353,301 A 11/1967 Heilweil et al.
3,353,321 A 11/1967 Heilweil et al.
3,358,059 A 12/1967 Snyder
3,379,481 A 4/1968 Fisher
3,408,316 A 10/1968 Mueller et al.
3,466,804 A * 9/1969 Swaneck, Jr. ..... F25D 23/087 49/483.1
3,471,416 A 10/1969 Fijal
3,597,850 A 8/1971 Jenkins
3,607,169 A 9/1971 Coxe
3,632,012 A 1/1972 Kitson
3,633,783 A 1/1972 Aue
3,634,971 A 1/1972 Kesling
3,635,536 A 1/1972 Lackey et al.
3,670,521 A 6/1972 Dodge, III et al.
3,688,384 A 9/1972 Mizushima et al.
3,769,770 A 11/1973 Deschamps et al.
3,862,880 A 1/1975 Feldman
3,868,829 A 3/1975 Mann et al.
3,875,683 A 4/1975 Waters
3,910,658 A 10/1975 Lindenschmidt
3,933,398 A 1/1976 Haag
3,935,787 A 2/1976 Fisher
4,005,919 A 2/1977 Hoge et al.
4,006,947 A 2/1977 Haag et al.
4,043,624 A 8/1977 Lindenschmidt
4,050,145 A 9/1977 Benford
4,067,628 A 1/1978 Sherbum
4,170,391 A 10/1979 Bottger
4,242,241 A 12/1980 Rosen et al.
4,260,876 A 4/1981 Hochheiser
4,303,730 A 12/1981 Torobin
4,303,732 A 12/1981 Torobin
4,325,734 A 4/1982 Burrage et al.
4,330,310 A 5/1982 Tate, Jr. et al.
4,332,429 A 6/1982 Frick et al.
4,396,362 A 8/1983 Thompson et al.
4,417,382 A 11/1983 Schilf
4,492,368 A 1/1985 DeLeeuw et al.
4,529,368 A 7/1985 Makansi
4,548,196 A 10/1985 Torobin
4,583,796 A 4/1986 Nakajima et al.
4,660,271 A 4/1987 Lenhardt
4,671,909 A 6/1987 Torobin
4,671,985 A 6/1987 Rodrigues et al.
4,681,788 A 7/1987 Barito et al.
4,745,015 A 5/1988 Cheng et al.
4,777,154 A 10/1988 Torobin
4,781,968 A 11/1988 Kellerman
4,805,293 A 2/1989 Buchser
4,865,875 A 9/1989 Kellerman
4,870,735 A 10/1989 Jahr et al.
4,914,341 A 4/1990 Weaver et al.
4,917,841 A 4/1990 Jenkins
5,007,226 A 4/1991 Nelson
5,018,328 A 5/1991 Cur et al.
5,033,636 A 7/1991 Jenkins
5,066,437 A 11/1991 Barito et al.
5,082,335 A 1/1992 Cur et al.
5,084,320 A 1/1992 Barito et al.
5,094,899 A 3/1992 Rusek, Jr.
5,118,174 A 6/1992 Benford et al.
5,121,593 A 6/1992 Forslund
5,157,893 A 10/1992 Benson et al.
5,168,674 A 12/1992 Molthen
5,171,346 A 12/1992 Hallett
5,175,975 A 1/1993 Benson et al.
5,212,143 A 5/1993 Torobin
5,221,136 A 6/1993 Hauck et al.
5,227,245 A 7/1993 Brands et al.
5,231,811 A 8/1993 Andrepont et al.
5,248,196 A 9/1993 Lynn et al.
5,251,455 A 10/1993 Cur et al.
5,252,408 A 10/1993 Bridges et al.
5,263,773 A 11/1993 Gable et al.
5,273,801 A 12/1993 Barry et al.
5,318,108 A 6/1994 Benson et al.
5,340,208 A 8/1994 Hauck et al.
5,353,868 A 10/1994 Abbott
5,359,795 A 11/1994 Mawby et al.
5,375,428 A 12/1994 LeClear et al.
5,397,759 A 3/1995 Torobin
5,418,055 A 5/1995 Chen et al.
5,433,056 A 7/1995 Benson et al.
5,477,676 A 12/1995 Benson et al.
5,500,287 A 3/1996 Henderson
5,500,305 A 3/1996 Bridges et al.
5,505,810 A 4/1996 Kirby et al.
5,507,999 A 4/1996 Copsey et al.
5,509,248 A 4/1996 Dellby et al.
5,512,345 A 4/1996 Tsutsumi et al.
5,532,034 A 7/1996 Kirby et al.
5,533,311 A 7/1996 Tirrell et al.
5,562,154 A 10/1996 Benson et al.
5,586,680 A 12/1996 Dellby et al.
5,599,081 A 2/1997 Revlett et al.
5,600,966 A 2/1997 Valence et al.
5,632,543 A 5/1997 McGrath et al.
5,640,828 A 6/1997 Reeves et al.
5,643,485 A 7/1997 Potter et al.
5,652,039 A 7/1997 Tremain et al.
5,694,789 A * 12/1997 Do ..... F25D 23/02 312/405
5,716,581 A 2/1998 Tirrell et al.
5,768,837 A 6/1998 Sjoholm
5,792,801 A 8/1998 Tsuda et al.
5,813,454 A 9/1998 Potter
5,826,780 A 10/1998 Neeser et al.
5,827,385 A 10/1998 Meyer et al.
5,834,126 A 11/1998 Sheu
5,843,353 A 12/1998 DeVos et al.
5,866,228 A 2/1999 Awata
5,866,247 A 2/1999 Klatt et al.
5,868,890 A 2/1999 Fredrick
5,900,299 A 5/1999 Wynne
5,918,478 A 7/1999 Bostic et al.
5,924,295 A 7/1999 Park
5,950,395 A 9/1999 Takemasa et al.
5,952,404 A 9/1999 Simpson et al.
5,966,963 A 10/1999 Kovalaske
5,985,189 A 11/1999 Lynn et al.
6,013,700 A 1/2000 Asano et al.
6,063,471 A 5/2000 Dietrich et al.
6,094,922 A 8/2000 Ziegler
6,109,712 A 8/2000 Haworth et al.
6,128,914 A 10/2000 Tamaoki et al.

(56) References Cited

U.S. PATENT DOCUMENTS 6,132,837 A 10/2000 Boes et al.
6,158,233 A 12/2000 Cohen et al.
6,163,976 A 12/2000 Tada et al.
6,164,030 A 12/2000 Dietrich
6,164,739 A 12/2000 Schulz et al.
6,187,256 B1 2/2001 Aslan et al.
6,209,342 B1 4/2001 Banicevic et al.
6,210,625 B1 4/2001 Matsushita et al.
6,220,473 B1 4/2001 Lehman et al.
6,221,456 B1 4/2001 Pogorski et al.
6,224,179 B1 5/2001 Wenning et al.
6,244,458 B1 6/2001 Frysinger et al.
6,260,377 B1 7/2001 Tamaoki et al.
6,266,970 B1 7/2001 Nam et al.
6,294,595 B1 9/2001 Tyagi et al.
6,305,768 B1 10/2001 Nishimoto
6,485,122 B2 1/2002 Wolf et al.
6,390,378 B1 5/2002 Briscoe, Jr. et al.
6,406,449 B1 6/2002 Moore et al.
6,408,841 B1 6/2002 Hirath et al.
6,415,623 B1 7/2002 Jennings et al.
6,428,130 B1 8/2002 Banicevic et al.
6,430,780 B1 8/2002 Kim et al.
6,460,955 B1 10/2002 Vaughan et al.
6,519,919 B1 2/2003 Takenouchi et al.
6,623,413 B1 9/2003 Wynne
6,629,429 B1 10/2003 Kawamura et al.
6,651,444 B2 11/2003 Morimoto et al.
6,655,766 B2 12/2003 Hodges
6,689,840 B1 2/2004 Eustace et al.
6,716,501 B2 4/2004 Kovalchuk et al.
6,736,472 B2 5/2004 Banicevic
6,749,780 B2 6/2004 Tobias
6,773,082 B2 8/2004 Lee
6,858,280 B2 2/2005 Allen et al.
6,860,082 B1 3/2005 Yamamoto et al.
6,938,968 B2 9/2005 Tanimoto et al.
6,997,530 B2 2/2006 Avendano et al.
7,008,032 B2 3/2006 Chekal et al.
7,026,054 B2 4/2006 Ikegawa et al.
7,197,792 B2 4/2007 Moon
7,197,888 B2 4/2007 LeClear et al.
7,207,181 B2 4/2007 Murray et al.
7,210,308 B2 5/2007 Tanimoto et al.
7,234,247 B2 6/2007 Maguire
7,263,744 B2 9/2007 Kim et al.
7,278,279 B2 10/2007 Hirai et al.
7,284,390 B2 10/2007 Van Meter et al.
7,296,432 B2 11/2007 Muller et al.
7,316,125 B2 1/2008 Uekado et al.
7,343,757 B2 3/2008 Egan et al.
7,360,371 B2 4/2008 Feinauer et al.
7,386,992 B2 6/2008 Adamski et al.
7,449,227 B2 11/2008 Echigoya et al.
7,475,562 B2 1/2009 Jackovin
7,517,031 B2 4/2009 Laible
7,517,576 B2 4/2009 Echigoya et al.
7,537,817 B2 5/2009 Tsunetsugu et al.
7,614,244 B2 11/2009 Venkatakrishnan et al.
7,625,622 B2 12/2009 Teckoe et al.
7,641,298 B2 1/2010 Hirath et al.
7,665,326 B2 2/2010 LeClear et al.
7,703,217 B2 4/2010 Tada et al.
7,703,824 B2 4/2010 Kittelson et al.
7,757,511 B2 7/2010 LeClear et al.
7,762,634 B2 7/2010 Tenra et al.
7,794,805 B2 9/2010 Aumaugher et al.
7,815,269 B2 10/2010 Wenning et al.
7,842,269 B2 11/2010 Schachtely et al.
7,845,745 B2 12/2010 Gorz et al.
7,861,538 B2 1/2011 Welle et al.
7,886,559 B2 2/2011 Hell et al.
7,893,123 B2 2/2011 Luisi
7,905,614 B2 3/2011 Aoki
7,908,873 B1 3/2011 Cur et al.
7,930,892 B1 4/2011 Vonderhaar
7,938,148 B2 5/2011 Carlier et al.
7,992,257 B2 8/2011 Kim
8,049,518 B2 11/2011 Wern et al.
8,074,469 B2 12/2011 Hamel et al.
8,079,652 B2 12/2011 Laible et al.
8,083,985 B2 12/2011 Luisi et al.
8,108,972 B2 2/2012 Bae et al.
8,113,604 B2 2/2012 Olson et al.
8,117,865 B2 2/2012 Allard et al.
8,157,338 B2 4/2012 Seo et al.
8,162,415 B2 4/2012 Hagele et al.
8,163,080 B2 4/2012 Meyer et al.
8,176,746 B2 5/2012 Allard et al.
8,182,051 B2 5/2012 Laible et al.
8,197,019 B2 6/2012 Kim
8,202,599 B2 6/2012 Henn
8,211,523 B2 7/2012 Fujimori et al.
8,266,923 B2 9/2012 Bauer et al.
8,281,558 B2 10/2012 Hiemeyer et al.
8,299,545 B2 10/2012 Chen et al.
8,299,656 B2 10/2012 Allard et al.
8,343,395 B2 1/2013 Hu et al.
8,353,177 B2 1/2013 Adamski et al.
8,382,219 B2 2/2013 Hottmann et al.
8,434,317 B2 5/2013 Besore
8,439,460 B2 5/2013 Laible et al.
8,453,476 B2 6/2013 Kendall et al.
8,456,040 B2 6/2013 Allard et al.
8,491,070 B2 7/2013 Davis et al.
8,516,845 B2 8/2013 Wuesthoff et al.
8,522,563 B2 9/2013 Allard et al.
8,528,284 B2 9/2013 Aspenson et al.
8,590,992 B2 11/2013 Lim et al.
8,717,029 B2 5/2014 Chae et al.
8,726,690 B2 5/2014 Cur et al.
8,733,123 B2 5/2014 Adamski et al.
8,739,567 B2 6/2014 Junge
8,739,568 B2 6/2014 Allard et al.
8,752,918 B2 6/2014 Kang
8,752,921 B2 6/2014 Gorz et al.
8,756,952 B2 6/2014 Adamski et al.
8,763,847 B2 7/2014 Mortarotti
8,764,133 B2 7/2014 Park et al.
8,770,682 B2 7/2014 Lee et al.
8,776,390 B2 7/2014 Hanaoka et al.
8,790,477 B2 7/2014 Tenra et al.
8,840,204 B2 9/2014 Bauer et al.
8,852,708 B2 10/2014 Kim et al.
8,871,323 B2 10/2014 Kim et al.
8,881,398 B2 10/2014 Hanley et al.
8,899,068 B2 12/2014 Jung et al.
8,905,503 B2 12/2014 Sahasrabudhe et al.
8,927,084 B2 1/2015 Jeon et al.
8,943,770 B2 2/2015 Sanders et al.
8,944,541 B2 2/2015 Allard et al.
8,986,483 B2 3/2015 Cur et al.
9,009,969 B2 4/2015 Choi et al.
RE45,501 E 5/2015 Maguire
9,056,952 B2 6/2015 Eilbracht et al.
9,074,811 B2 7/2015 Korkmaz
9,080,808 B2 7/2015 Choi et al.
9,102,076 B2 8/2015 Doshi et al.
9,103,482 B2 8/2015 Fujimori et al.
9,125,546 B2 9/2015 Kleemann et al.
9,140,480 B2 9/2015 Kuehl et al.
9,140,481 B2 9/2015 Curr et al.
9,170,045 B2 10/2015 Oh et al.
9,170,046 B2 10/2015 Jung et al.
9,188,382 B2 11/2015 Kim et al.
8,955,352 B2 12/2015 Lee et al.
9,221,210 B2 12/2015 Wu et al.
9,228,386 B2 1/2016 Thielmann et al.
9,252,570 B2 2/2016 Allard et al.
9,267,727 B2 2/2016 Lim et al.
9,303,915 B2 4/2016 Kim et al.
9,328,951 B2 5/2016 Shin et al.
9,353,984 B2 5/2016 Kim et al.
9,410,732 B2 8/2016 Choi et al.

(56) References Cited

U.S. PATENT DOCUMENTS 9,423,171 B2 8/2016 Betto et al.
9,429,356 B2 8/2016 Kim et al.
9,448,004 B2 9/2016 Kim et al.
9,463,917 B2 10/2016 Wu et al.
9,482,463 B2 11/2016 Choi et al.
9,506,689 B2 11/2016 Carbajal et al.
9,518,777 B2 12/2016 Lee et al.
9,568,238 B2 2/2017 Kim et al.
D781,641 S 3/2017 Incukur
D781,642 S 3/2017 Incukur
9,605,891 B2 3/2017 Lee et al.
9,696,085 B2 7/2017 Seo et al.
9,702,621 B2 7/2017 Cho et al.
9,759,479 B2 9/2017 Ramm et al.
9,777,958 B2 10/2017 Choi et al.
9,791,204 B2 10/2017 Kim et al.
9,833,942 B2 12/2017 Wu et al.
2002/0004111 A1 1/2002 Matsubara et al.
2002/0114937 A1 8/2002 Albert et al.
2002/0144482 A1 10/2002 Henson et al.
2002/0168496 A1 11/2002 Morimoto et al.
2003/0008100 A1 1/2003 Horn
2003/0041612 A1 3/2003 Piloni et al.
2003/0056334 A1 3/2003 Finkelstein
2003/0157284 A1 8/2003 Tanimoto et al.
2003/0167789 A1 9/2003 Tanimoto et al.
2003/0173883 A1 9/2003 Koons
2004/0144130 A1 7/2004 Jung
2004/0178707 A1 9/2004 Avendano
2004/0180176 A1 9/2004 Rusek
2004/0226141 A1 11/2004 Yates et al.
2004/0253406 A1 12/2004 Hayashi et al.
2005/0042247 A1 2/2005 Gomoll et al.
2005/0229614 A1 10/2005 Ansted
2005/0235682 A1 10/2005 Hirai et al.
2006/0064846 A1 3/2006 Espindola et al.
2006/0076863 A1 4/2006 Echigoya et al.
2006/0201189 A1 9/2006 Adamski et al.
2006/0261718 A1 11/2006 Miseki et al.
2006/0263571 A1 11/2006 Tsunetsugu et al.
2006/0266075 A1 11/2006 Itsuki et al.
2007/0001563 A1 1/2007 Park et al.
2007/0099502 A1 5/2007 Ferinauer
2007/0176526 A1 8/2007 Gomoll et al.
2007/0266654 A1 11/2007 Noale
2008/0044488 A1 2/2008 Zimmer et al.
2008/0048540 A1 2/2008 Kim
2008/0138458 A1 6/2008 Ozasa et al.
2008/0196441 A1 8/2008 Ferreira
2008/0300356 A1 12/2008 Meyer et al.
2008/0309210 A1 12/2008 Luisi et al.
2009/0032541 A1 2/2009 Rogala et al.
2009/0056367 A1 3/2009 Neumann
2009/0058244 A1 3/2009 Cho et al.
2009/0113925 A1 5/2009 Korkmaz
2009/0131571 A1 5/2009 Fraser et al.
2009/0179541 A1 7/2009 Smith et al.
2009/0205357 A1 8/2009 Lim et al.
2009/0302728 A1 12/2009 Rotter et al.
2009/0322470 A1 12/2009 Yoo et al.
2009/0324871 A1 12/2009 Henn
2010/0206464 A1 8/2010 Heo et al.
2010/0218543 A1 9/2010 Duchame
2010/0231109 A1 9/2010 Matzke et al.
2010/0287843 A1 11/2010 Oh
2010/0287974 A1 11/2010 Cur et al.
2010/0293984 A1 11/2010 Adamski et al.
2010/0295435 A1 11/2010 Kendall et al.
2011/0011119 A1 1/2011 Kuehl et al.
2011/0023527 A1 2/2011 Kwon et al.
2011/0030894 A1 2/2011 Tenra et al.
2011/0095669 A1 4/2011 Moon et al.
2011/0146325 A1 6/2011 Lee
2011/0146335 A1 6/2011 Jung et al.
2011/0165367 A1 7/2011 Kojima et al.
2011/0215694 A1 9/2011 Fink et al.
2011/0220662 A1 9/2011 Kim et al.
2011/0241513 A1 10/2011 Nomura et al.
2011/0241514 A1 10/2011 Nomura et al.
2011/0260351 A1 10/2011 Corradi et al.
2011/0290808 A1 12/2011 Bai et al.
2011/0309732 A1 12/2011 Horil et al.
2011/0315693 A1 12/2011 Cur et al.
2012/0000234 A1 1/2012 Adamski et al.
2012/0011879 A1 1/2012 Gu
2012/0060544 A1 3/2012 Lee et al.
2012/0073321 A1* 3/2012 Davis ..... F25D 23/028 62/449
2012/0099255 A1 4/2012 Lee et al.
2012/0103006 A1 5/2012 Jung et al.
2012/0104923 A1 5/2012 Jung et al.
2012/0118002 A1 5/2012 Kim et al.
2012/0137501 A1 6/2012 Allard et al.
2012/0152151 A1 6/2012 Meyer et al.
2012/0196059 A1 8/2012 Fujimori et al.
2012/0231204 A1 9/2012 Jeon et al.
2012/0237715 A1 9/2012 McCracken
2012/0240612 A1 9/2012 Wusthoff et al.
2012/0273111 A1 11/2012 Nomura et al.
2012/0279247 A1 11/2012 Katu et al.
2012/0280608 A1 11/2012 Park et al.
2012/0285971 A1 11/2012 Junge et al.
2012/0297813 A1 11/2012 Hanley et al.
2012/0324937 A1 12/2012 Adamski et al.
2013/0026900 A1 1/2013 Oh et al.
2013/0033163 A1 2/2013 Kang
2013/0043780 A1 2/2013 Ootsuka et al.
2013/0068990 A1 3/2013 Eilbracht et al.
2013/0111941 A1 5/2013 Yu et al.
2013/0221819 A1 8/2013 Wing
2013/0256318 A1 10/2013 Kuehl et al.
2013/0256319 A1 10/2013 Kuehl et al.
2013/0257256 A1 10/2013 Allard et al.
2013/0257257 A1 10/2013 Cur et al.
2013/0270732 A1 10/2013 Wu et al.
2013/0285527 A1 10/2013 Choi et al.
2013/0293080 A1 11/2013 Kim et al.
2013/0305535 A1 11/2013 Cur et al.
2013/0328472 A1 12/2013 Shim et al.
2014/0009055 A1 1/2014 Cho et al.
2014/0097733 A1 4/2014 Seo et al.
2014/0132144 A1 5/2014 Kim et al.
2014/0166926 A1 6/2014 Lee et al.
2014/0171578 A1 6/2014 Meyer et al.
2014/0190978 A1 7/2014 Bowman et al.
2014/0196305 A1 7/2014 Smith
2014/0216706 A1 8/2014 Melton et al.
2014/0232250 A1 8/2014 Kim et al.
2014/0260332 A1 9/2014 Wu
2014/0346942 A1 11/2014 Kim et al.
2014/0364527 A1 12/2014 Matthias et al.
2015/0011668 A1 1/2015 Kolb et al.
2015/0015133 A1 1/2015 Carbajal et al.
2015/0017386 A1 1/2015 Kolb et al.
2015/0027628 A1 1/2015 Cravens et al.
2015/0059399 A1 3/2015 Hwang et al.
2015/0115790 A1 4/2015 Ogg
2015/0147514 A1 5/2015 Shinohara et al.
2015/0159936 A1 6/2015 Oh et al.
2015/0168050 A1 6/2015 Cur et al.
2015/0176888 A1 6/2015 Cur et al.
2015/0184923 A1 7/2015 Jeon
2015/0190840 A1 7/2015 Muto et al.
2015/0224685 A1 8/2015 Amstutz
2015/0241115 A1 8/2015 Strauss et al.
2015/0241118 A1 8/2015 Wu
2015/0285551 A1 10/2015 Aiken et al.
2016/0084567 A1 3/2016 Fernandez et al.
2016/0116100 A1 4/2016 Thiery et al.
2016/0123055 A1 5/2016 Ueyama
2016/0161175 A1 6/2016 Benold et al.
2016/0178267 A1 6/2016 Hao et al.
2016/0178269 A1 6/2016 Hiemeyer et al.
2016/0235201 A1 8/2016 Soot

(56) References Cited

U.S. PATENT DOCUMENTS

| | | | |
|---|---|---|---|
| 2016/0240839 | A1 | 8/2016 | Umeyama et al. |
| 2016/0258671 | A1 | 9/2016 | Allard et al. |
| 2016/0290702 | A1 | 10/2016 | Sexton et al. |
| 2016/0348957 | A1 | 12/2016 | Hitzelberger et al. |
| 2017/0038126 | A1 | 2/2017 | Lee et al. |
| 2017/0157809 | A1 | 6/2017 | Deka et al. |
| 2017/0176086 | A1 | 6/2017 | Kang |
| 2017/0184339 | A1 | 6/2017 | Liu et al. |
| 2017/0191746 | A1 | 7/2017 | Seo |

FOREIGN PATENT DOCUMENTS

| | | | |
|---|---|---|---|
| CA | 2259665 | | 1/1998 |
| CA | 2640006 | | 8/2007 |
| CN | 1158509 | | 7/2004 |
| CN | 1970185 | | 5/2007 |
| CN | 100359272 | | 1/2008 |
| CN | 101437756 | | 5/2009 |
| CN | 201680116 | | 12/2010 |
| CN | 201748744 | U | 2/2011 |
| CN | 102296714 | | 5/2012 |
| CN | 102452522 | | 5/2012 |
| CN | 102717578 | A | 10/2012 |
| CN | 102720277 | | 10/2012 |
| CN | 103072321 | | 5/2013 |
| CN | 202973713 | U | 6/2013 |
| CN | 203331442 | | 12/2013 |
| CN | 104816478 | A | 8/2015 |
| CN | 105115221 | | 12/2015 |
| CN | 2014963379 | U | 1/2016 |
| DE | 1150190 | | 6/1963 |
| DE | 4110292 | A1 | 10/1992 |
| DE | 4409091 | | 9/1995 |
| DE | 19818890 | | 11/1999 |
| DE | 19914105 | | 9/2000 |
| DE | 19915311 | | 10/2000 |
| DE | 102008026528 | | 12/2009 |
| DE | 102009046810 | | 5/2011 |
| DE | 102010024951 | | 12/2011 |
| DE | 102011051178 | A1 | 12/2012 |
| DE | 102012223536 | | 6/2014 |
| DE | 102012223541 | | 6/2014 |
| EP | 0260699 | | 3/1988 |
| EP | 0480451 | | 4/1992 |
| EP | 0645576 | A1 | 3/1995 |
| EP | 0691518 | | 1/1996 |
| EP | 0860669 | | 8/1998 |
| EP | 1087186 | | 3/2001 |
| EP | 1200785 | | 5/2002 |
| EP | 1243880 | | 9/2002 |
| EP | 1496322 | | 1/2005 |
| EP | 1505359 | | 2/2005 |
| EP | 1602425 | A1 | 12/2005 |
| EP | 1624263 | A2 | 8/2006 |
| EP | 1484563 | | 10/2008 |
| EP | 2342511 | | 8/2012 |
| EP | 2543942 | A2 | 1/2013 |
| EP | 2607073 | | 6/2013 |
| EP | 2789951 | | 10/2014 |
| EP | 2878427 | A1 | 6/2015 |
| FR | 2980963 | | 4/2013 |
| FR | 2991698 | A1 | 12/2013 |
| GB | 837929 | | 6/1960 |
| GB | 1214548 | | 6/1960 |
| JP | 4828353 | | 8/1973 |
| JP | 51057777 | | 5/1976 |
| JP | 59191588 | | 12/1984 |
| JP | 03013779 | | 1/1991 |
| JP | 404165197 | | 6/1992 |
| JP | 04165197 | | 10/1992 |
| JP | 04309778 | A | 11/1992 |
| JP | 06159922 | | 6/1994 |
| JP | 7001479 | | 1/1995 |
| JP | H07167377 | | 7/1995 |
| JP | 08300052 | | 11/1996 |
| JP | H08303686 | | 11/1996 |
| JP | H09166271 | | 6/1997 |
| JP | 10113983 | | 5/1998 |
| JP | 11159693 | A | 6/1999 |
| JP | 11311395 | | 11/1999 |
| JP | 11336990 | | 12/1999 |
| JP | 2000097390 | | 4/2000 |
| JP | 2000117334 | | 4/2000 |
| JP | 2000320958 | A | 11/2000 |
| JP | 2001038188 | | 2/2001 |
| JP | 2001116437 | | 4/2001 |
| JP | 2001336691 | | 12/2001 |
| JP | 2001343176 | | 12/2001 |
| JP | 2002068853 | | 3/2002 |
| JP | 3438948 | | 8/2003 |
| JP | 03478771 | | 12/2003 |
| JP | 2004303695 | | 10/2004 |
| JP | 2005069596 | A | 3/2005 |
| JP | 2005098637 | A | 4/2005 |
| JP | 2005114015 | | 4/2005 |
| JP | 2005164193 | | 6/2005 |
| JP | 2005256849 | | 9/2005 |
| JP | 2006077792 | | 3/2006 |
| JP | 2006161834 | A | 6/2006 |
| JP | 2006161945 | | 6/2006 |
| JP | 03792801 | | 7/2006 |
| JP | 2006200685 | A | 8/2006 |
| JP | 2007263186 | | 10/2007 |
| JP | 4111096 | | 7/2008 |
| JP | 2008157431 | | 7/2008 |
| JP | 2008190815 | | 8/2008 |
| JP | 2009063064 | | 3/2009 |
| JP | 2009162402 | | 7/2009 |
| JP | 2009524570 | | 7/2009 |
| JP | 2010017437 | | 1/2010 |
| JP | 2010071565 | | 4/2010 |
| JP | 2010108199 | | 5/2010 |
| JP | 2010145002 | | 7/2010 |
| JP | 04545126 | B2 | 9/2010 |
| JP | 2010236770 | | 10/2010 |
| JP | 2010276309 | | 12/2010 |
| JP | 2011002033 | | 1/2011 |
| JP | 2011069612 | | 4/2011 |
| JP | 04779684 | | 9/2011 |
| JP | 2011196644 | | 10/2011 |
| JP | 2012026493 | | 2/2012 |
| JP | 04897473 | | 3/2012 |
| JP | 2012063029 | | 3/2012 |
| JP | 2012087993 | | 5/2012 |
| JP | 2012163258 | | 8/2012 |
| JP | 2012189114 | | 10/2012 |
| JP | 2012242075 | | 12/2012 |
| JP | 2013002484 | | 1/2013 |
| JP | 2013050242 | | 3/2013 |
| JP | 2013050267 | A | 3/2013 |
| JP | 2013076471 | A | 4/2013 |
| JP | 2013088036 | | 5/2013 |
| JP | 2013195009 | | 9/2013 |
| KR | 20020057547 | | 7/2002 |
| KR | 20020080938 | | 10/2002 |
| KR | 20030083812 | | 11/2003 |
| KR | 20040000126 | | 1/2004 |
| KR | 20050095357 | A | 9/2005 |
| KR | 100620025 | B1 | 9/2006 |
| KR | 20070044024 | | 4/2007 |
| KR | 1020070065743 | A | 6/2007 |
| KR | 1020080103845 | | 11/2008 |
| KR | 20090026045 | | 3/2009 |
| KR | 1017776 | | 2/2011 |
| KR | 20120007241 | | 1/2012 |
| KR | 2012046621 | | 5/2012 |
| KR | 2012051305 | | 5/2012 |
| KR | 20150089495 | A | 8/2015 |
| RU | 547614 | | 5/1977 |
| RU | 2061925 | C1 | 6/1996 |
| RU | 2077411 | C1 | 4/1997 |
| RU | 2081858 | | 6/1997 |
| RU | 2132522 | C1 | 6/1999 |
| RU | 2162576 | C2 | 1/2001 |

(56) References Cited

FOREIGN PATENT DOCUMENTS

| | | | |
|---|---|---|---|
| RU | 2166158 | C1 | 4/2001 |
| RU | 2187433 | C2 | 8/2002 |
| RU | 2234645 | C1 | 8/2004 |
| RU | 2252377 | | 5/2005 |
| RU | 2253792 | C2 | 6/2005 |
| RU | 2349618 | C2 | 3/2009 |
| RU | 2414288 | C2 | 3/2011 |
| RU | 2422598 | | 6/2011 |
| RU | 142892 | | 7/2014 |
| RU | 2529525 | C1 | 9/2014 |
| RU | 2571031 | | 12/2015 |
| SU | 203707 | | 12/1967 |
| SU | 00476407 | A1 | 7/1975 |
| SU | 648780 | A1 | 2/1979 |
| SU | 01307186 | A1 | 4/1987 |
| WO | 9614207 | A1 | 5/1996 |
| WO | 9721767 | | 6/1997 |
| WO | 1998049506 | | 11/1998 |
| WO | 02060576 | A1 | 4/1999 |
| WO | 9614207 | A1 | 4/1999 |
| WO | 9920961 | A1 | 4/1999 |
| WO | 9920964 | A1 | 4/1999 |
| WO | 199920964 | | 4/1999 |
| WO | 200160598 | | 8/2001 |
| WO | 200202987 | | 1/2002 |
| WO | 2002052208 | | 4/2002 |
| WO | 02060576 | A1 | 8/2002 |
| WO | 03072684 | A1 | 9/2003 |
| WO | 03089729 | | 10/2003 |
| WO | 2004010042 | A1 | 1/2004 |
| WO | 2006045694 | | 5/2006 |
| WO | 2006073540 | A2 | 7/2006 |
| WO | 2007033836 | A1 | 3/2007 |
| WO | 2007085511 | | 8/2007 |
| WO | 2007106067 | A2 | 9/2007 |
| WO | 2008065453 | | 6/2008 |
| WO | 2008077741 | | 7/2008 |
| WO | 2008118536 | A2 | 10/2008 |
| WO | 2008122483 | A2 | 10/2008 |
| WO | 2009013106 | A2 | 1/2009 |
| WO | 2009112433 | A1 | 9/2009 |
| WO | 2009147106 | | 12/2009 |
| WO | 2010007783 | A1 | 1/2010 |
| WO | 2010029730 | | 3/2010 |
| WO | 2010043009 | | 4/2010 |
| WO | 2010092627 | | 8/2010 |
| WO | 2010127947 | | 11/2010 |
| WO | 2010127947 | A2 | 11/2010 |
| WO | 2011003711 | | 1/2011 |
| WO | 2011058678 | | 5/2011 |
| WO | 2011058678 | A1 | 5/2011 |
| WO | 2011081498 | | 7/2011 |
| WO | 2010007783 | A1 | 1/2012 |
| WO | 2012023705 | | 2/2012 |
| WO | 2012026715 | | 3/2012 |
| WO | 2012031885 | | 3/2012 |
| WO | 2012044001 | | 4/2012 |
| WO | 2012043990 | | 5/2012 |
| WO | 2012085212 | | 6/2012 |
| WO | 2012119892 | | 9/2012 |
| WO | 2012152646 | | 11/2012 |
| WO | 2013116103 | | 8/2013 |
| WO | 2013116302 | | 8/2013 |
| WO | 2014038150 | | 3/2014 |
| WO | 2014038150 | A1 | 3/2014 |
| WO | 2014095542 | | 6/2014 |
| WO | 2014121893 | A1 | 8/2014 |
| WO | 2014184393 | | 11/2014 |
| WO | 2014184393 | A1 | 11/2014 |
| WO | 2013140816 | A1 | 8/2015 |
| WO | 2016082907 | A1 | 6/2016 |
| WO | 2017029782 | A1 | 2/2017 |

OTHER PUBLICATIONS

BASF, "Balindur™ Solutions for fixing Vaccum Insulated Panels," web page, 4 pages, date unknown, http://performance-materials.basf.us/products/view/family/balindur, at least as early as Dec. 21, 2015.

BASF, "Balindur™," web page, 2 pages, date unknown, http://product-finder.basf.com/group/corporate/product-finder/en/brand/BALINDUR, at least as early as Dec. 21, 2015.

PU Solutions Elastogram, "Balindur™ masters the challenge," web page, 2 pages, date unknown, http://product-finder.basf.com/group/corporate/product-finder/en/literature-document:/Brand+Balindur—Flyer--Balindur+The+new+VIP+fixation+technology-English.pdf, Dec. 21, 2014.

Kitchen Aid, "Refrigerator User Instructions," 120 pages, published Sep. 5, 2015.

Cai et al., "Generation of Metal Nanoparticles by Laser Ablation of Microspheres," J. Aerosol Sci., vol. 29, No. 5/6 (1998), pp. 627-636.

Raszewski et al., "Methods for Producing Hollow Glass Microspheres," Powerpoint, cached from Google, Jul. 2009, 6 pages.

* cited by examiner

Method 400 for Installing a Pantry Box System into a Refrigerating Appliance

SELF-CONTAINED PANTRY BOX SYSTEM FOR INSERTION INTO AN APPLIANCE

CROSS REFERENCE TO RELATED APPLICATION

The present application is a continuation of U.S. patent application Ser. No. 14/644,421 filed Mar. 11, 2015, entitled SELF-CONTAINED PANTRY BOX SYSTEM FOR INSERTION INTO AN APPLIANCE, the entire disclosure of which is hereby incorporated herein by reference.

FIELD OF THE INVENTION

The device is in the field of refrigerating appliances, specifically, a self-contained pantry box system for insertion into a refrigerating appliance.

BRIEF SUMMARY OF THE INVENTION

According to at least one aspect, a refrigerating appliance includes a cabinet having a plurality of sidewalls and a rear wall that define an interior volume. An interior mullion typically extends through a portion of the interior volume. The back wall, the sidewalls and the interior mullion define a refrigerator compartment and a freezer compartment, separated by the interior mullion. A refrigerator compartment door selectively covers at least a portion of the refrigerator compartment and a freezer compartment door selectively covers at least a portion of the freezer compartment. A plurality of doors may be used to enclose the refrigerator compartment and the freezer compartment, but typically a single or two doors enclose the compartments. A refrigeration system is also provided and typically includes a compressor, a condenser, an evaporator, an expansion device and a refrigerant. The refrigeration system operates to maintain the refrigerator compartment at a first temperature and maintain the freezer compartment at a second temperature typically lower than the first temperature and typically below freezing. A pantry box system is typically employed. The pantry box system defines a pantry compartment, and is disposed within a portion of the interior volume of the cabinet. The pantry box system includes a pantry wall and a base that define an internal pantry volume. At least one pantry drawer is in operable communication with the internal pantry volume. The at least one drawer is operable between open and closed positions. The at least one drawer includes an exterior drawer panel that conceals at least a portion of the pantry compartment and covers at least a portion of the refrigerator compartment when the at least one pantry drawer is in the closed position. A top mullion of the pantry box system includes an interstitial mullion space, a pantry box cooling system that provides cooled air from at least one of: the refrigerator compartment, the freezer compartment and the refrigeration system. The pantry box cooling system is typically configured to maintain the internal pantry volume at a third temperature and an interface portion defined within one of the sidewalls, back wall and interior mullion of the cabinet. The pantry box system engages the cabinet at the interface portion such that the refrigeration system is placed in communication with the pantry box cooling system.

According to at least another aspect, a pantry box system for installation in a refrigerator compartment of a refrigerating appliance includes a pantry mullion having an interstitial space defined therein. A pantry wall extends perpendicularly from the pantry mullion. A base is positioned proximate the pantry wall and is positioned substantially parallel with the pantry mullion. The pantry mullion, the pantry wall and the base define an insertable pantry compartment having an internal pantry volume. At least one pantry drawer is in operable communication with the internal pantry volume. The at least one pantry drawer is operable through a drawer aperture defined in the pantry wall between open and closed positions. Each at least one pantry drawer includes an exterior drawer panel that conceals the drawer aperture when the at least one pantry drawer in in the closed position. A pantry box cooling system is configured to deliver cooling to the insertable pantry compartment from an external location when the insertable pantry compartment is positioned within an appliance. The pantry box cooling system includes a control that independently controls at least one pantry temperature of the internal pantry volume of the insertable pantry compartment.

At least another aspect of the present disclosure is generally directed to a method for installing a pantry box system into a refrigerating appliance to create a thermally independent pantry compartment includes the step of providing an appliance having a cabinet having a plurality of sidewalls and a rear wall that define an interior volume. The interior volume is divided by an interior mullion to further define a refrigerator compartment and a freezer compartment. According to various steps of the embodiments of the method, an appliance cooling system is provided having a compressor, a condenser, an evaporator, an expansion device and a refrigerant, wherein the appliance cooling system is incorporated within a machine component of the appliance and in communication with the refrigerator and freezer compartments. The appliance cooling system is configured to maintain the refrigerator compartment at a first temperature and maintain the freezer compartment at a second temperature, which is typically less than the first temperature and also typically below freezing. The appliance cooling system is in communication with an interface portion of the cabinet. A pantry box system is provided having a perimeter wall, a base and a pantry mullion that define an insertable pantry compartment, and a pantry box cooling system in communication with the insertable pantry compartment. A pantry ice maker is disposed, within an interstitial mullion space defined within the pantry mullion, and wherein the pantry ice maker is in communication with the pantry box cooling system. The pantry ice maker is configured to deliver ice to a portion of the pantry compartment. The pantry box system is positioned in the refrigerator compartment, wherein the insertable pantry compartment is defined within the refrigerator compartment. The pantry box system is connected to the interface portion of the cabinet such that the pantry box cooling system is in communication with the appliance cooling system, wherein the pantry box cooling system maintains the pantry compartment at a third temperature, and wherein the first, second and third temperatures can be independently modified. At least one pantry drawer is inserted into an aperture defined in the pantry compartment. Each at least one pantry drawer includes an exterior drawer panel that conceals at least a portion of the pantry compartment and covers at least a portion of the refrigerator compartment when the at least one pantry drawer is in the closed position.

These and other features, advantages, and objects of the present invention will be further understood and appreciated by those skilled in the art by reference to the following specification, claims, and appended drawings.

BRIEF DESCRIPTION OF THE DRAWINGS

The foregoing summary, as well as the following detailed description of the invention, will be better understood when read in conjunction with the appended drawings. For the purpose of illustrating the invention, there are shown in the drawings, certain embodiment(s) which are presently preferred. It should be understood, however, that the invention is not limited to the precise arrangements and instrumentalities shown. Drawings are not necessary to scale. Certain features of the invention may be exaggerated in scale or shown in schematic form in the interest of clarity and conciseness.

DETAILED DESCRIPTION

Figure 1:
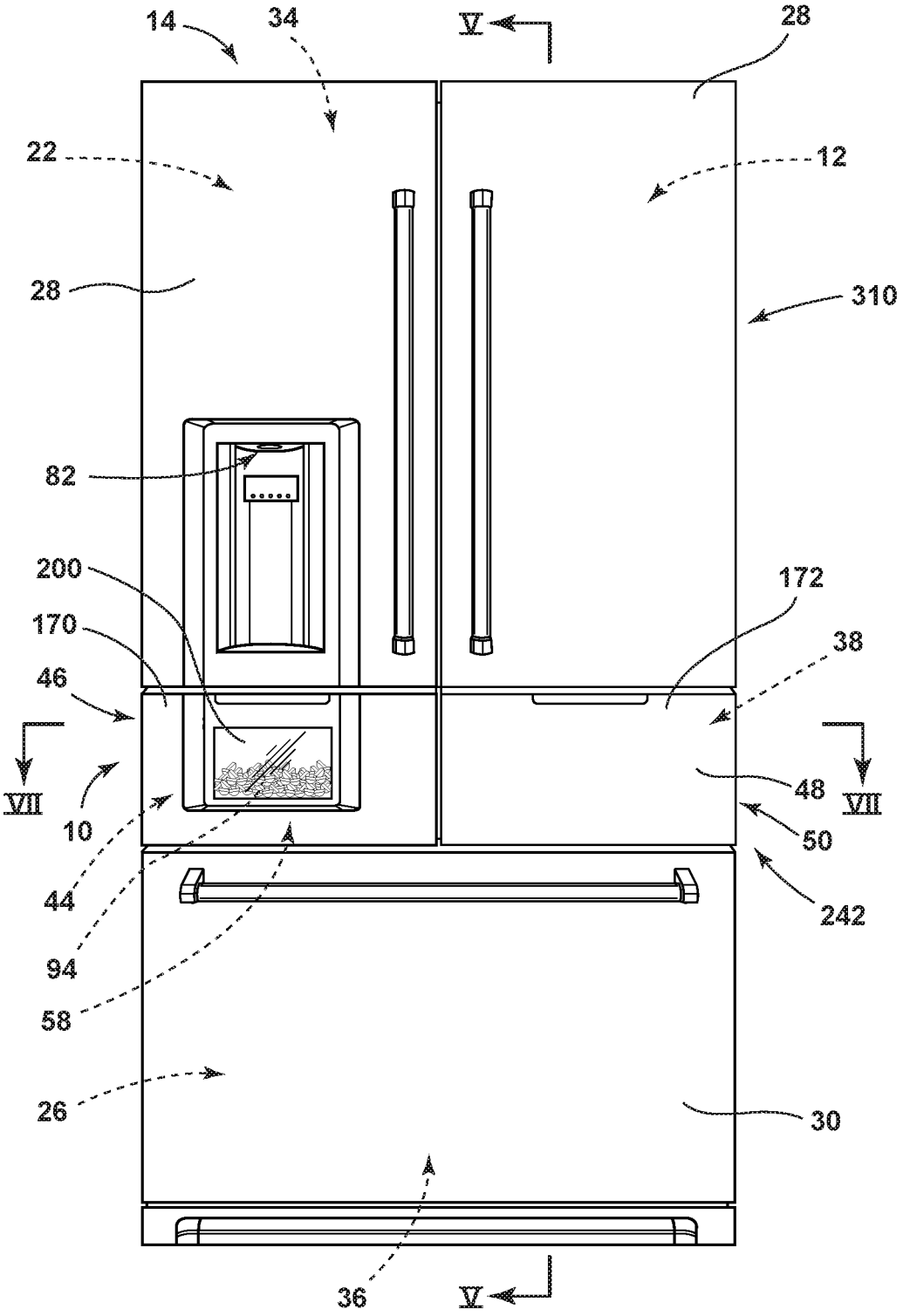
FIG. 1 is a front elevational view of a refrigerating appliance incorporating an embodiment of an insertable pantry box system.
Figure 2:
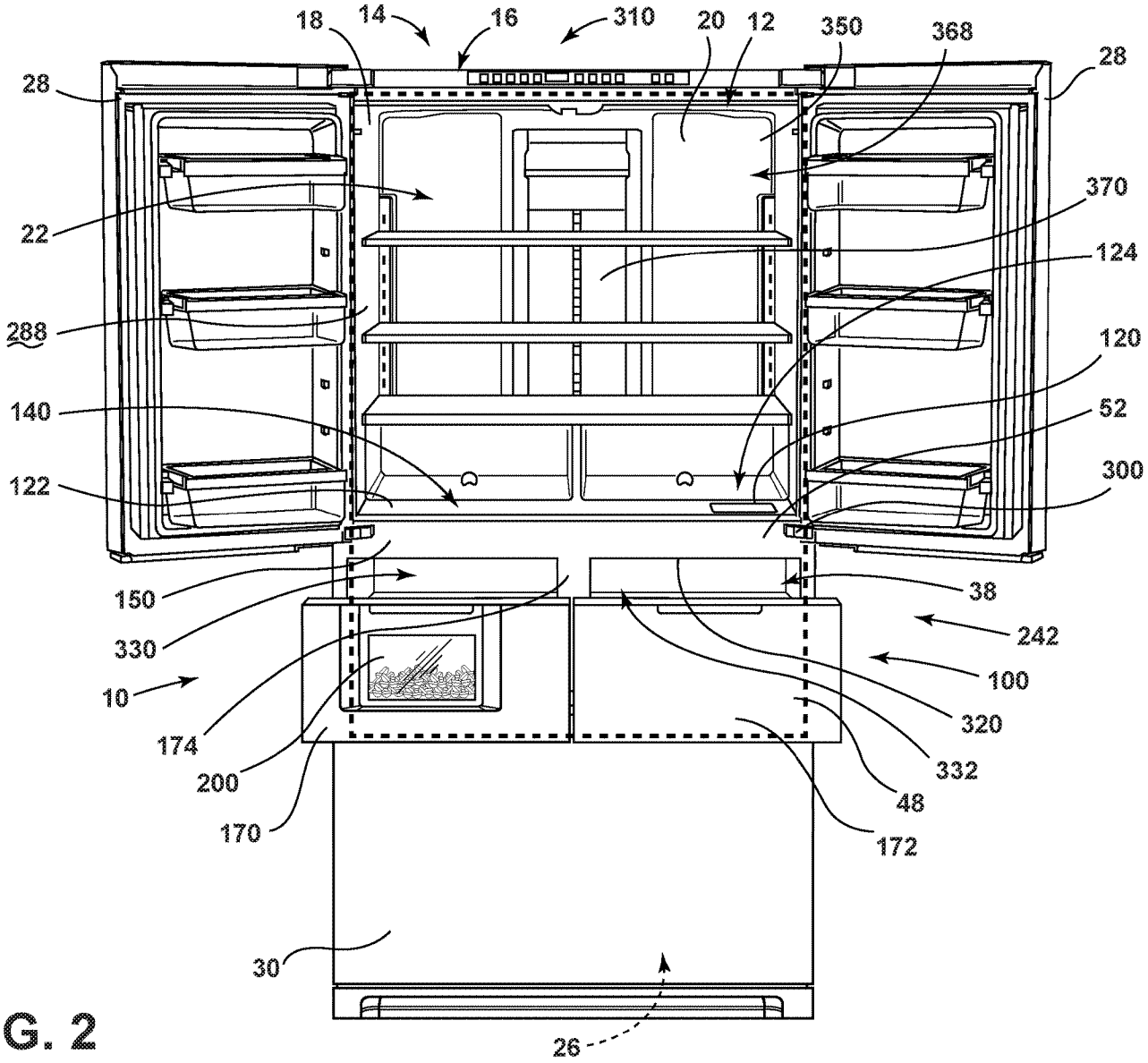
FIG. 2 is a front perspective view of the appliance of FIG. 1 with the refrigerator doors and the pantry drawers in an open position.

Before the subject invention is described further, it is to be understood that the invention is not limited to the particular embodiments of the invention described below, as variations of the particular embodiments may be made and still fall within the scope of the appended claims. It is also to be understood that the terminology employed is for the purpose of describing particular embodiments, and is not intended to be limiting. Instead, the scope of the present invention will be established by the appended claims.

Where a range of values is provided, it is understood that each intervening value, to the tenth of the unit of the lower limit unless the context clearly dictates otherwise, between the upper and lower limit of that range, and any other stated or intervening value in that stated range, is encompassed within the invention. The upper and lower limits of these smaller ranges may independently be included in the smaller ranges, and are also encompassed within the invention, subject to any specifically excluded limit in the stated range. Where the stated range includes one or both of the limits, ranges excluding either or both of those included limits are also included in the invention.

In this specification and the appended claims, the singular forms "a," "an" and "the" include plural reference unless the context clearly dictates otherwise.

As illustrated in FIGS. 1-7, reference numeral 10 generally refers to an insertable pantry box system configured to be installed within a refrigerator compartment 12 of a refrigerating appliance 14, according to one embodiment. The refrigerating appliance 14 can include a cabinet 16 having a plurality of sidewalls 18 and a rear wall 20 that define an interior volume 22. An interior mullion 24 of the refrigerating appliance 14 extends through a portion of the interior volume 22, where the rear wall 20, sidewalls 18 and the interior mullion 24 define a refrigerator compartment 12 and a freezer compartment 26 separated by the interior mullion 24. A refrigerator compartment door 28 selectively covers at least a portion of the refrigerator compartment 12. Also included is a freezer compartment door 30 that selectively covers the freezer compartment 26.

A refrigeration system 32 of the refrigerating appliance 14 includes a compressor, a condenser, an evaporator, an expansion device and a refrigerant (all not shown) that is moved through the refrigeration system 32. The refrigeration system 32 operates to maintain a refrigerator compartment 12 at a first temperature 34, and also maintain a freezer compartment 26 at a second temperature 36. Generally, the second temperature 36 of the freezer compartment 26 is lower than the first temperature 34 of the refrigerator compartment 12.

The pantry box system 10 defines a pantry compartment 38 and can be disposed within a portion of the interior volume 22 of the cabinet 16. It is contemplated that the pantry box system 10 can be installed within the refrigerator compartment 12 or the freezer compartment 26, as will be described more fully below.

According to the various embodiments, the pantry box system 10 can include a pantry wall 40 and a base 42 that define an internal pantry volume 44. At least one pantry drawer 46 is in operable communication with the internal pantry volume 44, where the at least one pantry drawer 46 is operable between the open position 100 (FIG. 2) and closed position 50 (FIG. 1). The at least one pantry drawer 46 includes an external drawer panel 48 that conceals at least a portion of the pantry compartment 38 and also covers at least a portion of a refrigerator compartment 12 when the at least one pantry drawer 46 is in the closed position 50 and the pantry box system 10 is installed within the refrigerator compartment 12. The pantry box system 10 can also include a top mullion 52 that defines an interstitial mullion space 54. The interstitial mullion space 54 can include a substantially hollow or open region within the top mullion 52. In this manner, the interstitial mullion space 54 is an open area that is capable of housing and allowing for the operation of various water-related, electrical and/or mechanical features of the refrigerating appliance 14, the pantry box system 10, or both.

Figure 8:
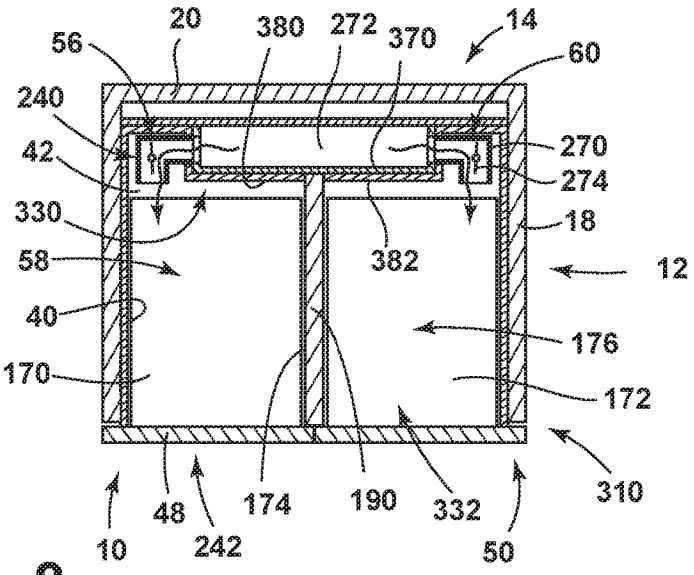
FIG. 8 is the schematic cross-sectional view of FIG. 7, but illustrating an alternate pantry box cooling system configuration installed in the pantry box system.
Figure 7:
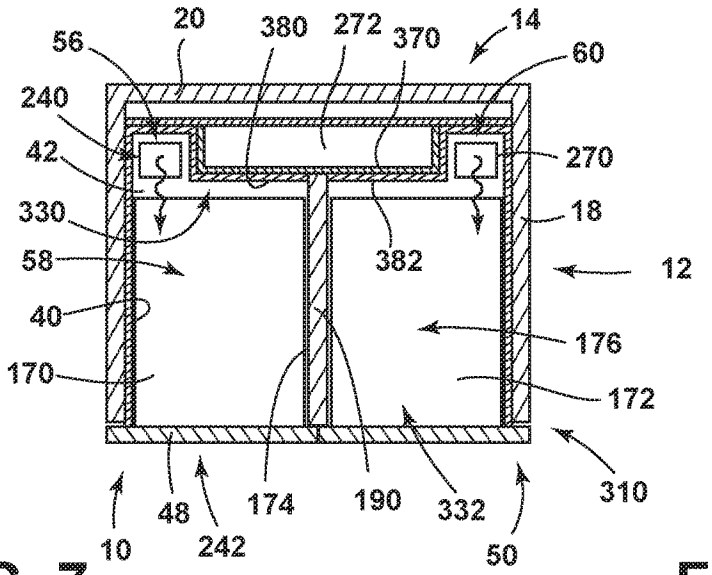
FIG. 7 is a schematic cross-sectional view of the refrigerating appliance of FIG. 1, taken along line VII-VII in FIG. 1.
Figure 9:
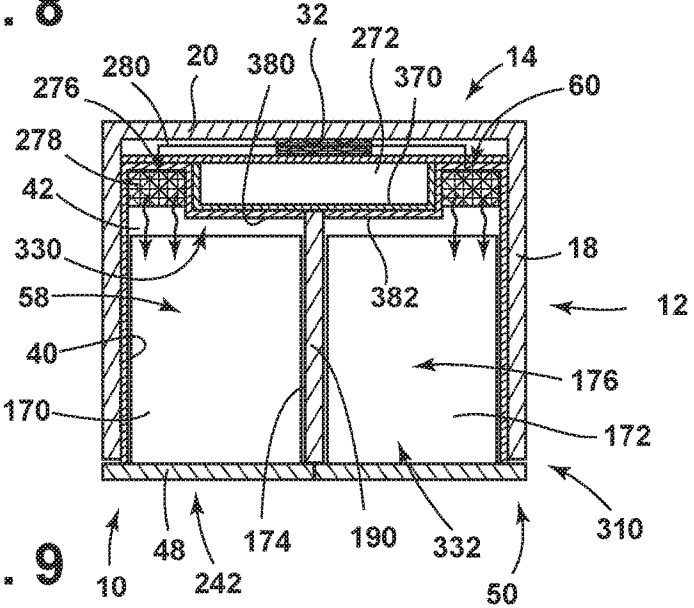
FIG. 9 is the schematic cross-sectional view of FIG. 7, but illustrating an alternate pantry box cooling system configuration installed in the pantry box system.

Referring again to FIGS. 5-7, it is contemplated that a pantry box cooling system 56 of the pantry box system 10 can provide cooled air from at least one of the refrigerator compartment 12 (shown in FIG. 8), the freezer compartment 26, or the refrigeration system 32 of the refrigerating appliance 14 (shown in FIG. 9). The pantry box cooling system 56 is configured to maintain the internal pantry volume 44 at a third temperature 58. It is contemplated that the third temperature 58 of the internal pantry volume 44 can be the same or different than either or both of the first and second temperatures 34, 36 of the refrigerator compartment 12 and freezer compartment 26, respectively. The cabinet 16 of the refrigerating appliance 14 can include an interface portion 60 that can be defined within one or more of the sidewalls 18, rear wall 20, or interior mullion 24 of the cabinet 16. It is contemplated that the pantry box system 10 can engage the cabinet 16 at the interface portion 60 such that the refrigeration system 32 is placed in communication with the pantry box cooling system 56 in order to maintain the internal pantry volume 44 at the third temperature 58.

Referring again to the embodiment illustrated in FIGS. 1-7, it is contemplated that in addition to the pantry box cooling system 56, the pantry box system 10 can also include a pantry water system 80 that is at least partially disposed within the interstitial mullion space 54 of the top mullion 52 of the pantry box system 10. It is contemplated that when the pantry box system 10 is engaged with the interface portion 60 of the refrigerating appliance 14, the pantry water system 80 is placed in communication with an appliance water system 82 of the refrigerating appliance 14. According to the various embodiments, the appliance water system 82 can provide water to the various functions of the refrigerating appliance 14 that require water, where such functions can include, but are not limited to, forming ice, delivering water, and other similar functions, where such functions can be performed at various and multiple locations within the refrigerating appliance 14. It is contemplated that the appliance water system 82 of the refrigerating appliance 14 can include various water lines 84 that are run through the cabinet 16 into a portion of the interface portion 60 of the refrigerating appliance 14. In this manner, the appliance water system 82 extends to and is in communication with the interface portion 60 of the cabinet 16.

Referring again to the embodiment illustrated in FIGS. 1-10, it is contemplated that the pantry box system 10 can include a pantry ice maker 90 that is disposed at least partially within the interstitial mullion space 54. The pantry ice maker 90 can be placed in communication with the pantry water system 80, such that when the pantry box system 10 is engaged with the interface portion 60 of the cabinet 16, the appliance water system 82 can provide water through the interface portion 60 and into the pantry water system 80 of the pantry box system 10 for delivery of water to the pantry ice maker 90. It is also contemplated that fluid from the appliance water system 82 can be routed directly through the interface portion 60 and directly to the pantry ice maker 90. In such an embodiment, the fluid from the appliance water system 82 can be filtered at a location within the appliance 14 before reaching the interface portion 60. It is also contemplated that the pantry ice maker 90 can be positioned within the interstitial mullion space 54 such that the pantry ice maker 90 is in communication with an ice/food bin 92 disposed within at least one of the pantry drawers 46 of the pantry box system 10. In this manner, the pantry ice maker 90 can be configured to deliver formed ice 94 from the pantry ice maker 90 to the ice/food bin 92 disposed within one of the drawers of the pantry box system 10.

According to the various embodiments, the pantry box system 10 can include at least two drawers, each individually operable within the pantry box system 10 between open and closed positions 100, 50. In this manner, the ice/food bin 92 for the pantry box system 10 can be disposed within one of the two or more pantry drawers 46 for receiving ice from the pantry ice maker 90 when the pantry drawer 46 is in the closed position 50. It is contemplated that the pantry box system 10 can be configured such that the pantry ice maker 90 is temporarily disengaged from delivering ice when the pantry drawer 46 is moved to an open position 100, to prevent unwanted delivery of ice outside of the ice/food bin 92 disposed within one of the pantry drawers 46 of the pantry box system 10.

Referring again to the embodiment illustrated in FIGS. 1-7, the pantry box system 10 can include a water filter 110 and water tank 112 that are typically disposed within the interstitial mullion space 54, or at least partially within the interstitial mullion space 54. In this manner, the water filter 110 and water tank 112 are placed in communication with the pantry water system 80. According to the various embodiments, it is contemplated that water delivered to the pantry water system 80 through the interface portion 60 and from the appliance water system 82 can be first delivered to the water filter 110 disposed within the interstitial mullion space 54. Once filtered through the water filter 110 within the interstitial mullion space 54, water from the pantry water system 80 can then be delivered through the water utilizing portions of the pantry box system 10 that include, but are not limited to, the pantry ice maker 90, the water tank 112, a water delivery system, and other similar functions. In addition, the water filter 110 disposed within the interstitial mullion space 54 can be used as the water filtration mechanism for the entire refrigerating appliance 14, such that water can be delivered into the pantry water system 80, filtered through the water filter 110 disposed within the interstitial mullion space 54, and then delivered back through the interface portion 60 and into an outgoing portion of the appliance water system 82 for delivery to various functions of the refrigerating appliance 14 that require water and/or filtered water. It is also contemplated that the water tank 112 and the water filter 110 can be disposed in other portions of the pantry box system 10 or the refrigerating appliance 14.

Figure 4:
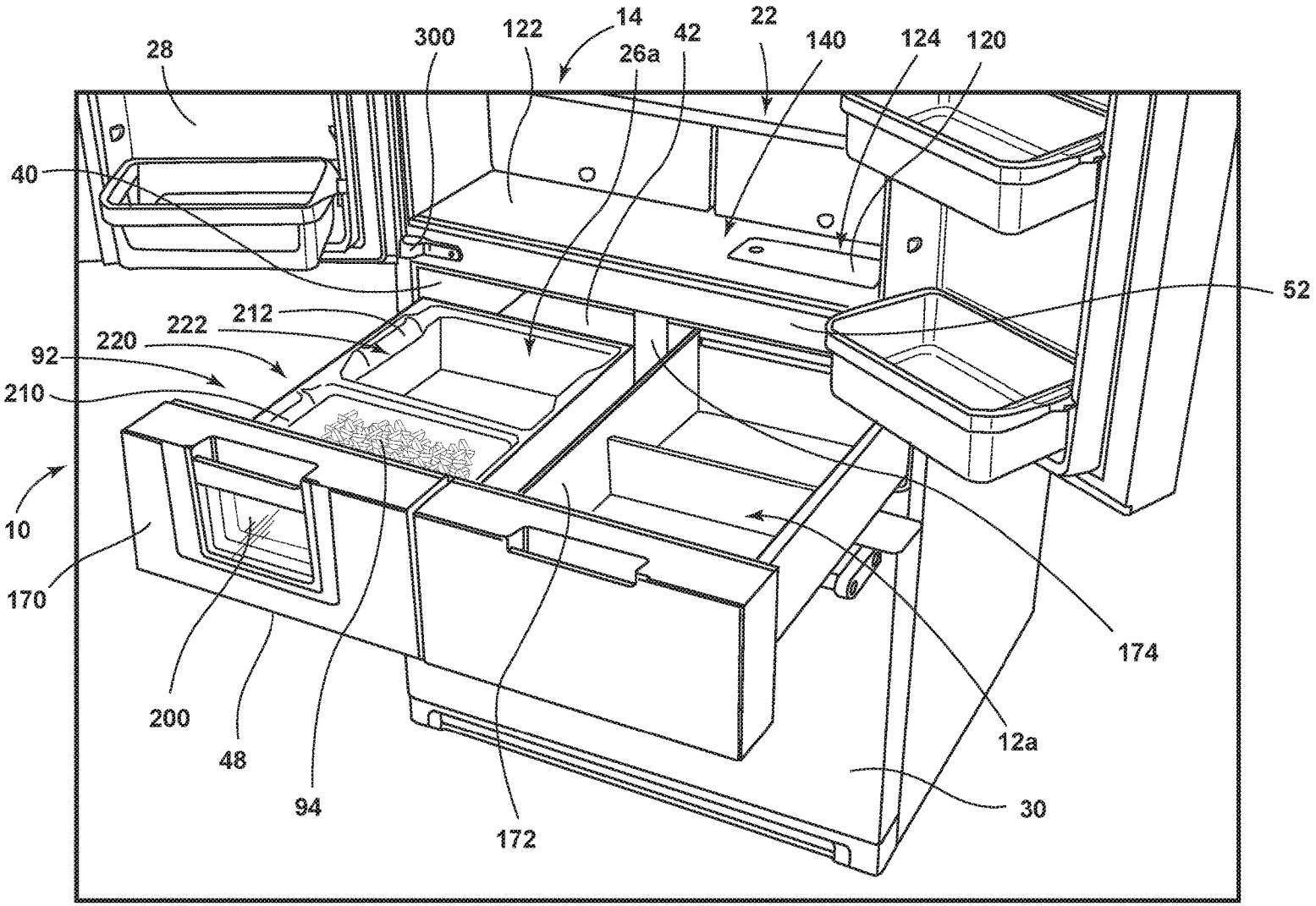
FIG. 4 is another top perspective view of the pantry box system of FIG. 3.
Figure 5:
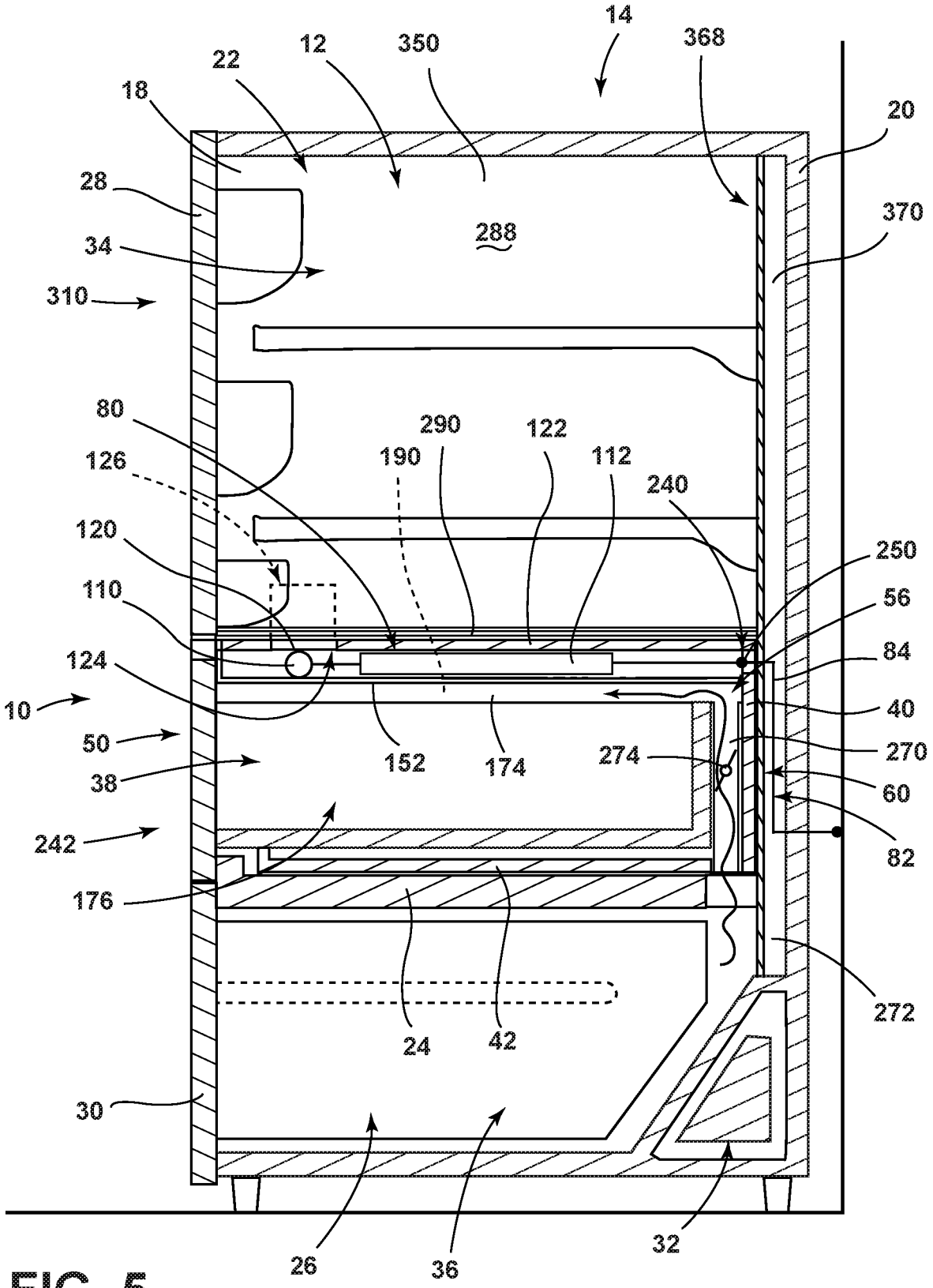
FIG. 5 is a cross-sectional view of the refrigerating appliance of FIG. 1, taken along line V-V in FIG. 1.
Figure 6:
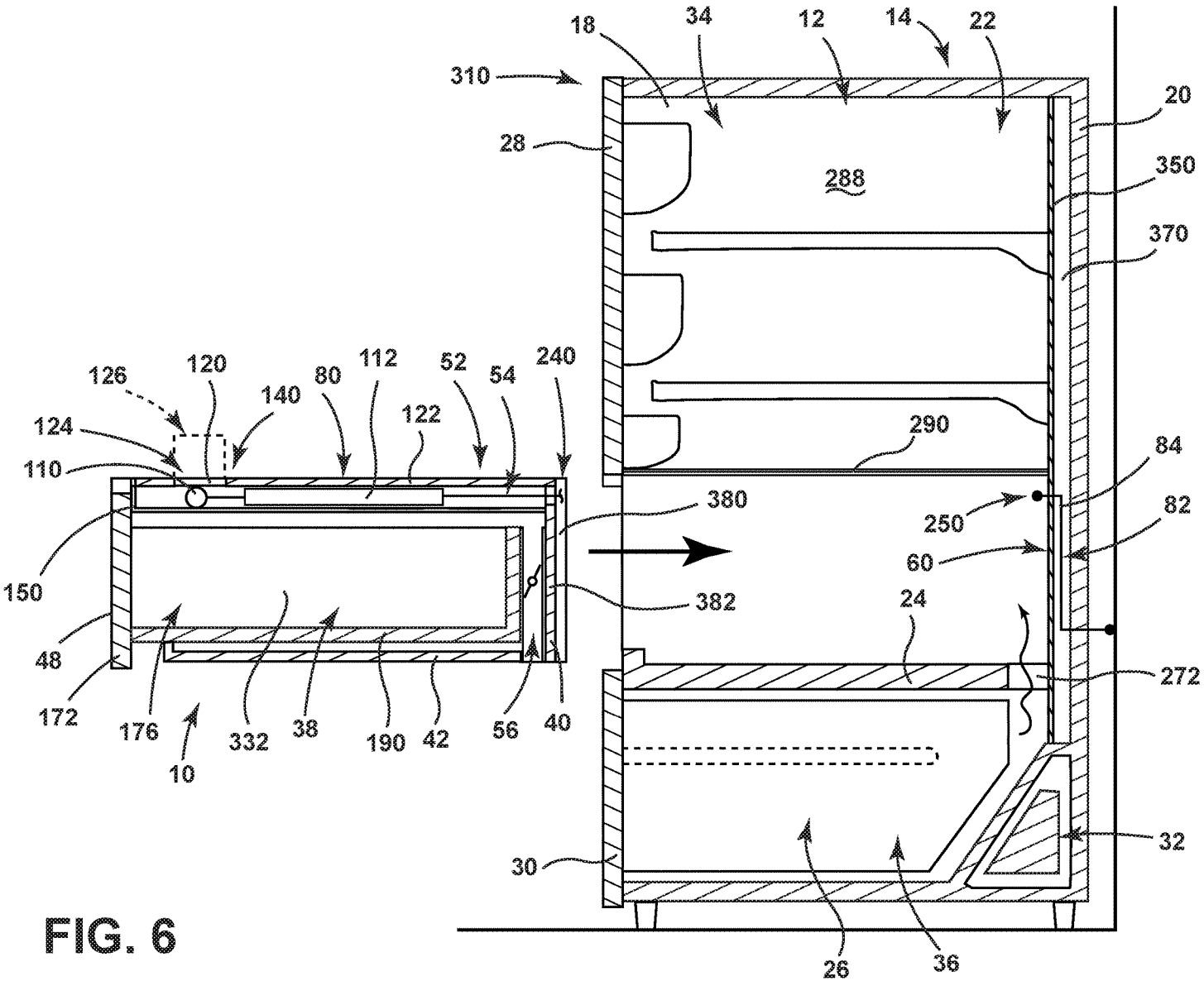
FIG. 6 is a partially exploded cross-sectional view of the refrigerating appliance of FIG. 5 with the insertable pantry box system about to be installed into the refrigerator compartment of the refrigerating appliance.

Referring again to the embodiments illustrated in FIGS. 4-6, it is contemplated that the water filter 110 disposed within the interstitial mullion space 54 can be accessed by a user through a portion of the refrigerator compartment 12. Accordingly, an operable access panel 120 can be defined within a wall, such as a top wall 122, of the top mullion 52 of the pantry box system 10. In the various embodiments, when the water filter 110 is to be installed, replaced, maintained, or otherwise accessed by a user, the operable access panel 120 can be removed from the top wall 122 of the top mullion 52, thereby revealing the water filter 110 and allowing the user to directly access the water filter 110. It is contemplated that the operable access panel 120 can be moved from a concealing position 124 where the water filter 110 is concealed by the operable access panel 120 to an access position 126 where the operable access panel 120 is moved such that the water filter 110 is accessible to the user. In order to move the operable access panel 120 to the access position 126, the operable access panel 120 can include various operable mechanisms that can include, but are not limited to, hinge mechanisms, sliding mechanisms, mating tabs for complete removal of the operable access panel 120, combinations of these mechanisms and other similar attachment mechanisms that provide for the movement of the operable access panel 120 between the concealing and access positions 124, 126.

Referring again to the embodiment illustrated in FIGS. 4-6, it is contemplated that the water filter 110 and the operable access panel 120 that provides access to the water filter 110 can be disposed in a front portion 140 of the top mullion 52 in a position near the refrigerator compartment door 28 of the refrigerating appliance 14. In this manner, the operable access panel 120 can be disposed such that the user is only required to open the refrigerator compartment door 28 in order to access the operable access panel 120 for gaining access to the water filter 110. Such a position of the water filter 110 in the operable access panel 120 can allow the user to access the water filter 110 without manipulating shelves within the refrigerator compartment 12, moving food items or other containers stored within the refrigerator compartment 12, or having to move other various objects that are stored within the refrigerator compartment 12. The positioning of the operable access panel 120 and the water filter 110 in front of the refrigerator compartment 12 provides the user with ready access to the water filter 110. According to the various embodiments, it is contemplated that the operable access panel 120 can include a color and finish that is substantially similar to the surrounding areas of the refrigerator compartment 12 and the top mullion 52 of the pantry box system 10. In this manner, the operable access panel 120 for the water filter 110 can be substantially inconspicuous within the refrigerator compartment 12.

According to the various embodiments, it is also contemplated that the water filter 110 can be disposed in other portions of the pantry box system 10. In an alternate embodiment, the water filter 110 and operable access panel 120 can be positioned at the front portion 140 of the top mullion 52, where the operable access panel 120 can be defined within a front face 150 of the top mullion 52. In another alternate embodiment, the water filter 110 can be accessed through an operable access panel 120 disposed within an area proximate the internal pantry volume 44. In such an embodiment, the movement of one or more of the pantry drawers 46 toward the open position 100 may be required such that the user can reach an underside 152 of the interstitial mullion space 54 to move the operable access panel 120 to the access position 126 and reach the water filter 110. Such a position can be used where greater concealment of the operable access panel 120 is desired.

Referring again to the embodiment illustrated in FIGS. 1-6, it is contemplated that the pantry box system 10 can include a plurality of pantry drawers 46, where the pantry box system 10 can include a first drawer 170 and a second drawer 172 that are separated by a medial wall 174 extending through a portion of the pantry box system 10. In such an embodiment, it is contemplated that the first and second drawers 170, 172 are placed in communication with the pantry box cooling system 56. It is also contemplated that the first drawer 170 can be maintained at the third temperature 58 of the pantry box system 10 and the second drawer 172 of the pantry box system 10 can be maintained at a fourth temperature 176. In such an embodiment, the first temperature 34 of the refrigerator compartment 12, the second temperature 36 of the freezer compartment 26, the third temperature 58 of the first drawer 170 and the fourth temperature 176 of the second drawer 172 can all be independently adjustable and separately controlled to define a plurality of temperatures. Accordingly, the first, second, third and fourth temperatures 34, 36, 58, 176 can be set to the same temperature or can be set four different individual temperatures, or combinations of similar and dissimilar temperatures.

According to the various embodiments, the pantry box system 10 can include one or more insulated panels 190 that are defined by the top mullion 52, the pantry wall 40, the base 42, and the medial wall 174, such that thermal transfer between the various compartments of the refrigerating appliance 14 can be accurately controlled. According to various embodiments, because of the insulated panels 190 of the pantry box system 10, one or both of the pantry drawers 46 can be maintained at a temperature above or below the refrigerator compartment 12 and/or the freezer compartment 26. Thermal transfer between the first and second drawers 170, 172 and the freezer and refrigerator compartment 26, 12 can be minimized due to the presence of the insulated panels 190 of the pantry box system 10.

Referring again to FIGS. 1-7, it is also contemplated that the pantry box cooling system 56 can include various pantry ducts 270 extending between the refrigerator and/or freezer compartment 12, 26 to deliver chilled air from within the refrigerator and/or freezer compartments 12, 26 for providing cooling to the first and/or second drawers 170, 172. Accordingly, the first drawer 170 can define a refrigerator pantry compartment 12*a* or a freezer pantry compartment 26*a*. Similarly, the second drawer 172 can also define a refrigerator pantry compartment 12*a* or a freezer pantry compartment 26*a*, regardless of what temperature the first drawer 170 may be set at. Additionally, the medial wall 174 extending between the first and second drawers 170, 172 provides further insulation through the insulated panel 190 to prevent thermal transfer between the first and second drawers 170, 172.

Referring again to the embodiment illustrated in FIGS. 1-7, it is contemplated that one or more of the pantry drawers 46 can include a viewing window 200 disposed within the exterior drawer panel of one or both of the first and second drawers 170, 172. Such a viewing window 200 can be substantially insulated to prevent the substantial escape of cooled air when the first and second drawers 170, 172 are in the closed position 50. Such a viewing window 200 can also provide the user an opportunity to view of the contents of the first and/or second drawers 170, 172 without requiring the user to move the first or second drawers 170, 172 to an open position 100, which may tend to release cooled air to external portions of the refrigerating appliance 14, and thereby require the use of additional energy to bring the first and/or second drawers 170, 172 back to the desired third and fourth temperatures 58, 176, respectively.

Figure 3:
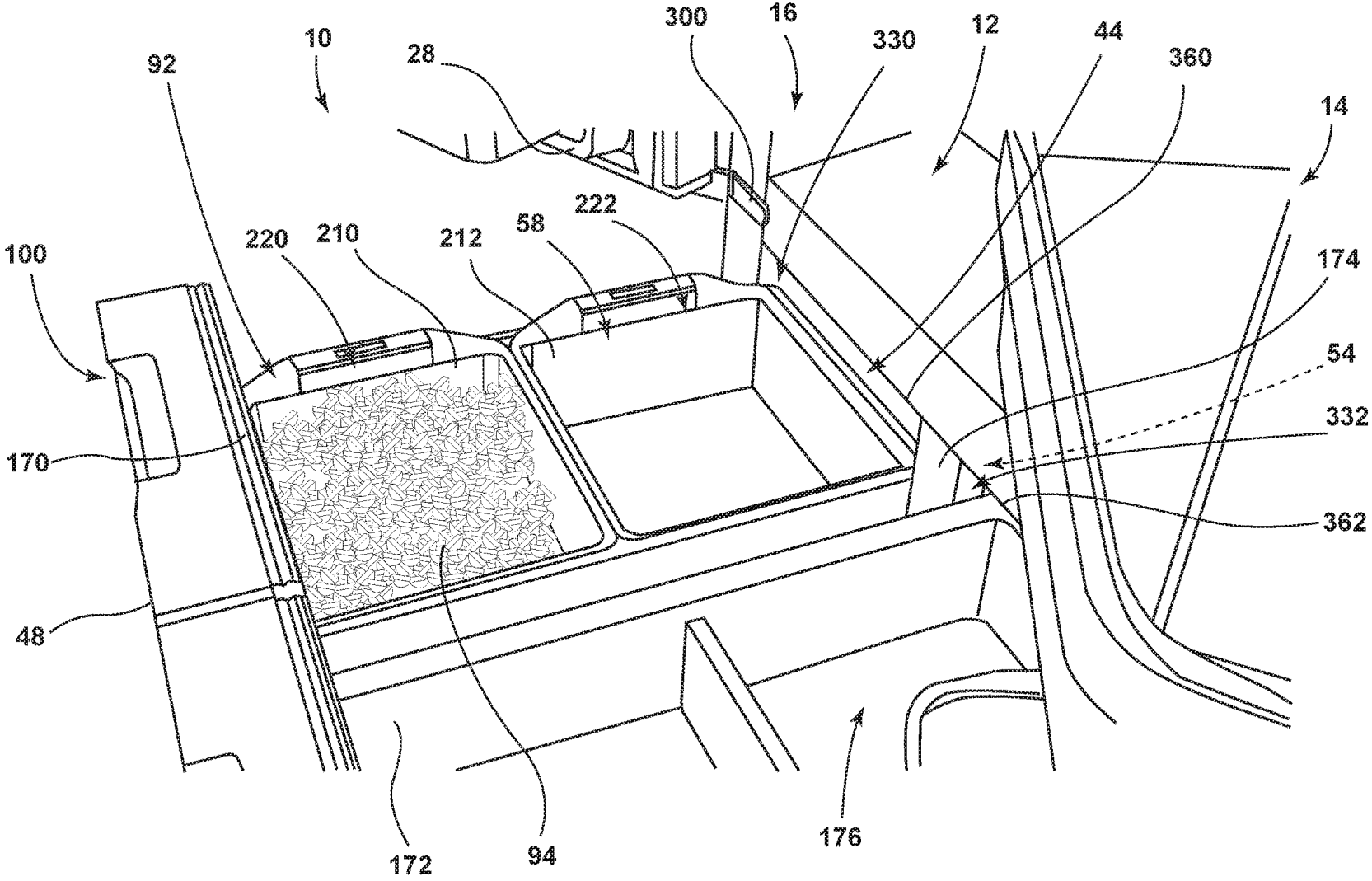
FIG. 3 is a top perspective view of the insertable pantry box system installed within a refrigerating appliance.

Referring again to the embodiments illustrated in FIGS. 3 and 4, it is contemplated that one of the first and second drawers 170, 172 can include the ice/food bin 92 that receives formed ice 94 from the pantry ice maker 90. It is contemplated that the ice/food bin 92 can include first and second ice/food compartments 210, 212 that are independently and selectively removable from the first drawer 170. It is also contemplated that at least one of the first and second ice/food compartments 210, 212 can be viewed through the viewing window 200 disposed within the external drawer panel 48 of the first and/or second drawer 170, 172 that houses the ice/food bin 92 when the particular pantry drawer 46 is in the closed position 50. According to the various embodiments, it is contemplated that the first and second ice/food compartments 210, 212 can take up substantially all of the internal space of the first drawer 170 of the pantry box system 10. In such an embodiment, substantial amounts of ice can be stored within the first drawer 170. Such amounts of ice can be up to ten pounds of ice or more, depending on the size of the first drawer 170.

In various alternate embodiments, it is contemplated that the ice/food bin 92 can include a single compartment, where the single compartment can be slid within the first drawer 170. According to the various embodiments, it is contemplated that the ice/food bin 92 having a single ice/food compartment can be moved between a forward and rearward position 220, 222 within the first drawer 170. When in one of these positions, the ice/food bin 92 can be placed in communication with the pantry ice maker 90 such that ice can be delivered to the ice/food bin 92. It is contemplated that once a predetermined amount of ice is disposed within the ice/food bin 92, the pantry ice maker 90 can be deactivated through the use of various ice monitoring mechanisms. According to various alternate embodiments, it is contemplated that the movement of the ice/food bin 92 between the forward and rearward positions 220, 222 can serve to activate and deactivate the pantry ice maker 90. In such an embodiment, the placement of the ice/food bin 92 in one of the forward and rearward positions 220, 222 can activate the pantry ice maker 90. It is contemplated that the movement of the ice/food bin 92 to the opposing position can be configured to deactivate the pantry ice maker 90, such that no ice will be delivered to the ice/food bin 92 or the pantry drawer 46 in the absence of the ice/food bin 92 being in the proper position to activate the pantry ice maker 90.

According to the various embodiments, the various ice/food bins 92 can be suspended from sidewalls or on a lip of the first drawer 170 and/or the second drawer 172. It is contemplated that the various ice/food bins 92 can be removed by hand and without the use of tools. Any one or more of the ice/food bins 92 can be adapted to contain ice or food stuffs within the respective ice/food compartment defined therein. It is also contemplated that an ice/food bin in the forward position 220 can be engaged with an ice/food bin in the rearward position 222 to store added amounts of ice, such as for use during a high ice-usage event like a party or other social gathering, or during production of ice cream, or other substantially similar occurrence. It is also contemplated that the various ice/food bins 92 can be supported by the bottom surface of either of the pantry drawers 46.

Referring again to the embodiment illustrated in FIGS. 5 and 6, the pantry box system 10 can be manufactured in a separate facility from the remainder of the refrigerating appliance 14. The pantry box system 10 can include the various mechanisms for providing functionalities for the pantry box system 10, where such functions can include the pantry ice maker 90, the water filter 110, the water tank 112, the ice/food bin 92, a water delivery system, combinations of these, and other similar functional mechanisms. Accordingly, the pantry box system 10 can be manufactured as a self-contained unit that can be delivered to the appliance assembly location, which can be in a separate building or manufacturing facility. The remainder of the refrigerating appliance 14, including the refrigerator compartment 12, the freezer compartment 26, the various doors of the refrigerator and freezer compartment 12, 26 can be manufactured at a separate location, and the pantry box system 10 can be inserted into the refrigerator compartment 12 or the freezer compartment 26 as an entire unit during manufacture of the refrigerating appliance 14.

Referring now to the embodiments illustrated in FIGS. 5-9, as the pantry box system 10 is inserted within the refrigerator or freezer compartment 12, 26, a pantry box interface 240 disposed upon a portion of the pantry box system 10 can be engaged with the interface portion 60 of the cabinet 16 of the refrigerating appliance 14. It is contemplated that the engagement between the pantry box interface 240 and the interface portion 60 can be a substantially "plug-and-play" connection, whereby the insertion of the pantry box system 10 into an installed position 242 within the refrigerator and/or freezer compartment 12, 26 can automatically engage the appliance water system 82 with the pantry water system 80. It is also contemplated that at least some tightening or manual engagement of connections between the various portions of the cabinet 16 and the pantry box, using tools or by hand and without the use of tools, can serve to connect the systems together.

By way of explanation, and not limitation, a cabinet connection port 250 of the appliance water system 82 that extends into the area where the pantry box system 10 is to be disposed to define the installed position 242, can include a nut, weld point, or other fastening mechanism that is installed to a receiving portion of the pantry water system 80 that is configured to engage the appliance water system 82. These connection points can be fixed together through a mechanical mechanism, such as through a compression fitting, male/female connector, or other similar connection.

As illustrated in the embodiments of FIGS. 5-9, it is also contemplated that the pantry box cooling system 56 can be engaged with the refrigeration system 32 of the cabinet 16 through the installation of the pantry box system 10 into the installed position 242 within the cabinet 16 of the refrigerating appliance 14. In various embodiments, the pantry box cooling system 56 can include one or more pantry ducts 270 that engage corresponding appliance ductwork 272 running from at least one of the refrigerator compartment 12 and/or the freezer compartment 26. The pantry ducts 270 of the pantry box cooling system 56 provide for the delivery of air from the refrigerator and/or freezer compartment 12, 26 and/or from the cooling tower 370 into the first and second drawers 170, 172 of the pantry box system 10. The pantry ducts 270 of the pantry box cooling system 56 can also include various dampers 274 that can be controlled to regulate the amount of cooled air that is delivered to the first and second drawers 170, 172 from the refrigerator and/or freezer compartments 12, 26, and/or from the cooling tower 370.

According to various alternate embodiments, as illustrated in FIG. 9, it is contemplated that the pantry box cooling system 56 can include a pantry refrigeration line 276 that connects to one or more pantry evaporators 278, where the pantry refrigeration line 276 engages an appliance refrigeration line 280 of the refrigeration system 32 of the refrigerating appliance 14. In this manner, when the pantry box system 10 is placed in the installed position 242, it is contemplated that the pantry refrigeration line 276 can substantially align with the appliance refrigeration line 280.

It is contemplated that the pantry refrigeration line 276 can provide refrigerant to a single pantry evaporator 278 configured to provide cooling to the first and second drawers 170, 172. Alternatively, the pantry refrigeration line 276 can provide refrigerant to two dedicated pantry evaporators 278 that individually and separately provide cooling to the first and second drawers 170, 172 to maintain the third and fourth temperatures 58, 176, respectively.

Typically, the connection of two refrigeration lines requires bonding, welding, adhesives, or other similar connection method to fully connect the two opposing refrigeration lines together to prevent refrigerant leaks. It is also contemplated that the refrigeration line can incorporate a compression or other mechanical-type fitting to engage the pantry refrigeration line and the appliance refrigeration line to place the pantry box cooling system 56 in communication with the refrigeration system 32 of the refrigerating appliance 14. During operation of the refrigerating appliance 14 having the pantry box system 10 installed therein, refrigerant from the appliance refrigeration system 32 can be delivered to the one or more evaporators disposed within the pantry box cooling system 56 such that cooling can be delivered to the first and second drawers 170, 172 of the pantry box system 10.

According to various alternate embodiments, the pantry box system 10 can include a self-contained pantry box cooling system 56 that includes a separate pantry compressor, pantry condenser, pantry expansion device, and the one or more pantry evaporators, as well as a separate pantry refrigerant that is delivered through the self-contained pantry box cooling system 56. In such an embodiment, installation of the pantry box system 10 into the cabinet 16 of the refrigerating appliance 14 can include connection of the electrical system of the refrigerating appliance 14 with a pantry electrical system for operating the various electrical functions of the pantry box system 10. It is also contemplated that in various embodiments of the pantry box system 10 that do not have a self-contained pantry box cooling system 56, as described above, the insertion of the pantry box system 10 into the installed position 242 within the cabinet 16 of the refrigerating appliance 14 can include connection of the appliance electrical system with the pantry electrical system to provide electrical power for the various electrical functions of the pantry box system 10. Such electrical functions of the pantry box system 10 can include, but are not limited to, lights, a user interface, fog/condensation control mechanisms, heaters, among others.

Referring again to the embodiment illustrated in FIGS. 5 and 6, the interior surface 288 of the cabinet 16 of the refrigerating appliance 14 can include guide surfaces 290 within the refrigerator and/or freezer compartments 12, 26 that serve to substantially align the pantry box system 10 within the cabinet 16 of the refrigerating appliance 14. The guide surfaces 290 defined within the interior surface 288 of the cabinet 16 can also serve to substantially secure the pantry box system 10 within the cabinet 16 of the refrigerating appliance 14 in the installed position 242.

According to the various embodiments, it is contemplated that when the pantry box system 10 is installed within the cabinet 16 of the refrigerating appliance 14, a finished inner liner 350 can be disposed within the cabinet 16 to provide a finished surface for the refrigerator and/or freezer compartment 12, 26 that contains the pantry box system 10. In such an embodiment, the finished liner 350 can provide a surface that substantially conceals the scene that appears between the pantry box system 10 and the refrigerator or freezer compartment 12, 26 within which the pantry box system 10 is installed.

Referring again to FIGS. 1-6, the refrigerator compartment doors 28 can include different configurations that can be incorporated into the refrigerating appliance 14 depending on whether the pantry box system 10 is installed in the refrigerator compartment 12 or not. A set of bottom hinges 300 for the refrigerator compartment doors 28 can be disposed proximate the top mullion 52 of the pantry box system 10. In this manner, the refrigerator compartment doors 28 are configured to extend from the top of the external drawer panels 48 for the pantry drawers 46 to a position proximate the top of the refrigerating appliance 14. Alternatively, where the pantry box system 10 is not installed in the refrigerator compartment 12, the bottom hinges 300 can be installed proximate the interior mullion 24. In this configuration, the refrigerator compartment doors 28 can be longer to extend from the top of the freezer compartment door 30 to the top of the refrigerating appliance 14. This alternate bottom hinge positioning can allow for the manufacture of a base cabinet 310 for a refrigerating appliance 14. This base cabinet 310 can be used for a variety of models of refrigerating appliances 14 that can incorporate varying configurations of pantry compartment 38 (single drawer, multi-drawer, swaying door, etc.), or no pantry compartment 38 at all. This flexibility of the base cabinet 310 can save time, material, labor and cost by not having to manufacture separate cabinets 16 for each model of refrigerating appliance 14.

Figure 10:
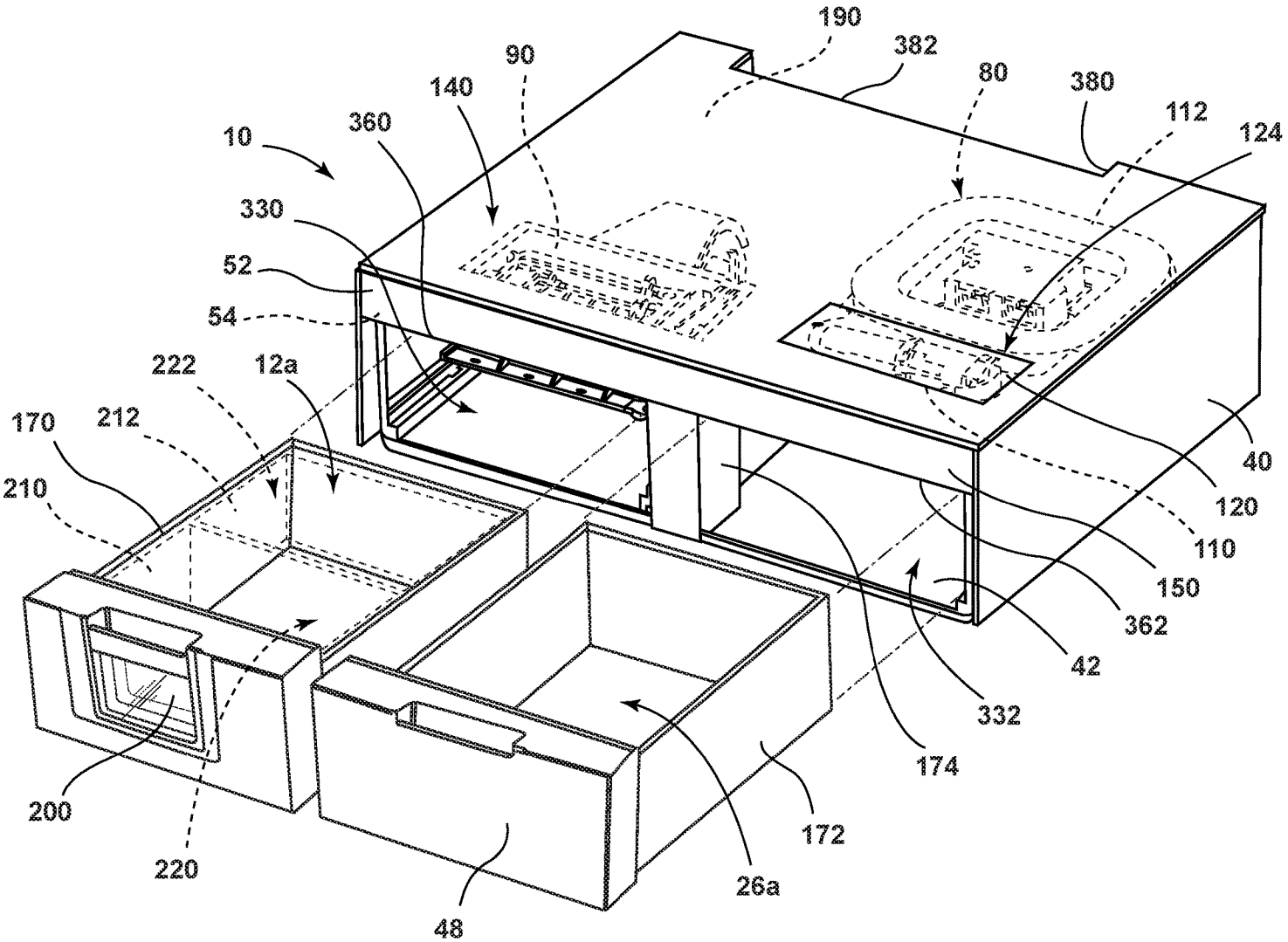
FIG. 10 is a partially exploded top perspective view of another alternate embodiment of the insertable pantry box system with the pantry drawers removed.
Figure 11:
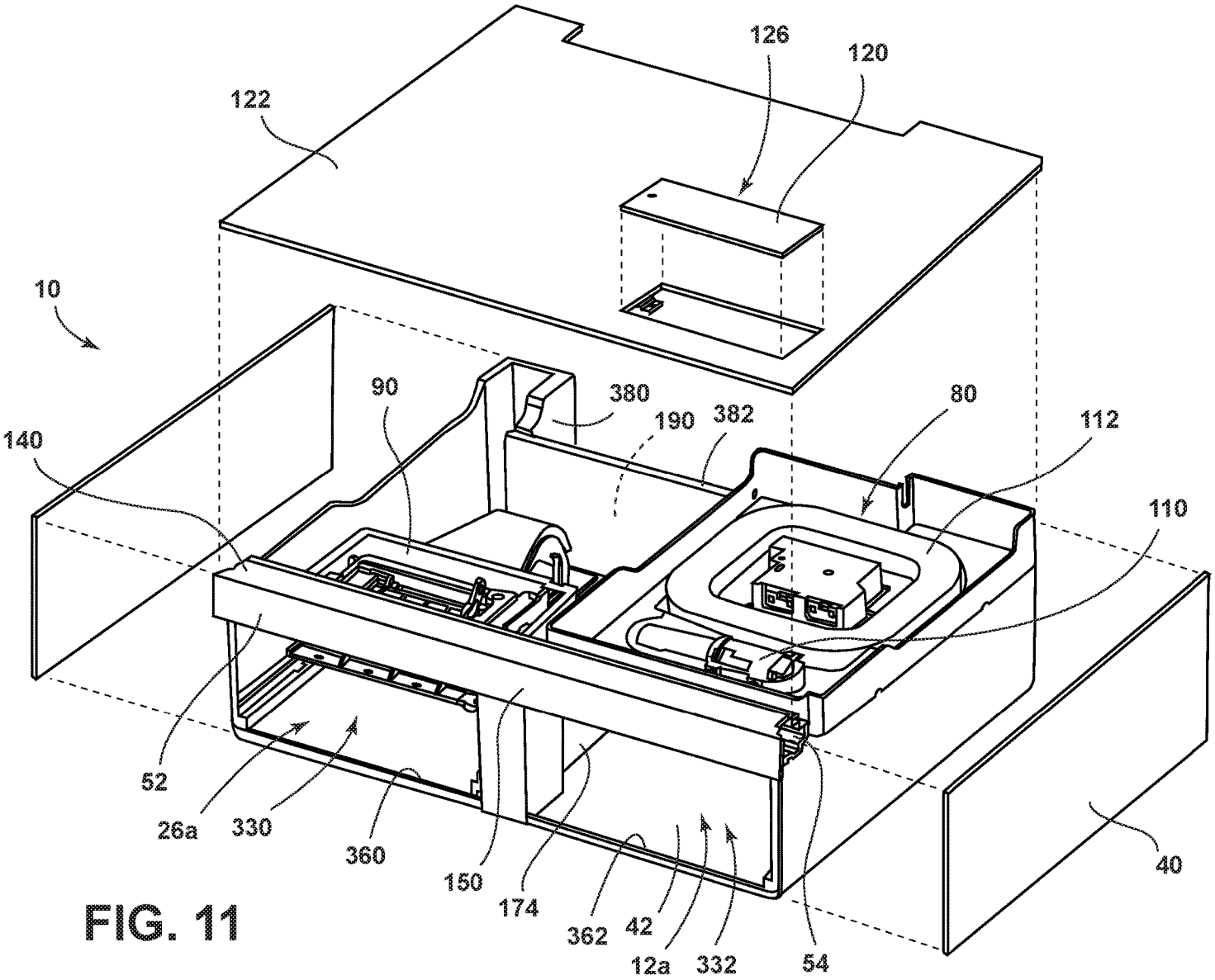
FIG. 11 is a partially exploded top perspective view of the insertable pantry box system of FIG. 4, removed from the appliance.
Figure 12:
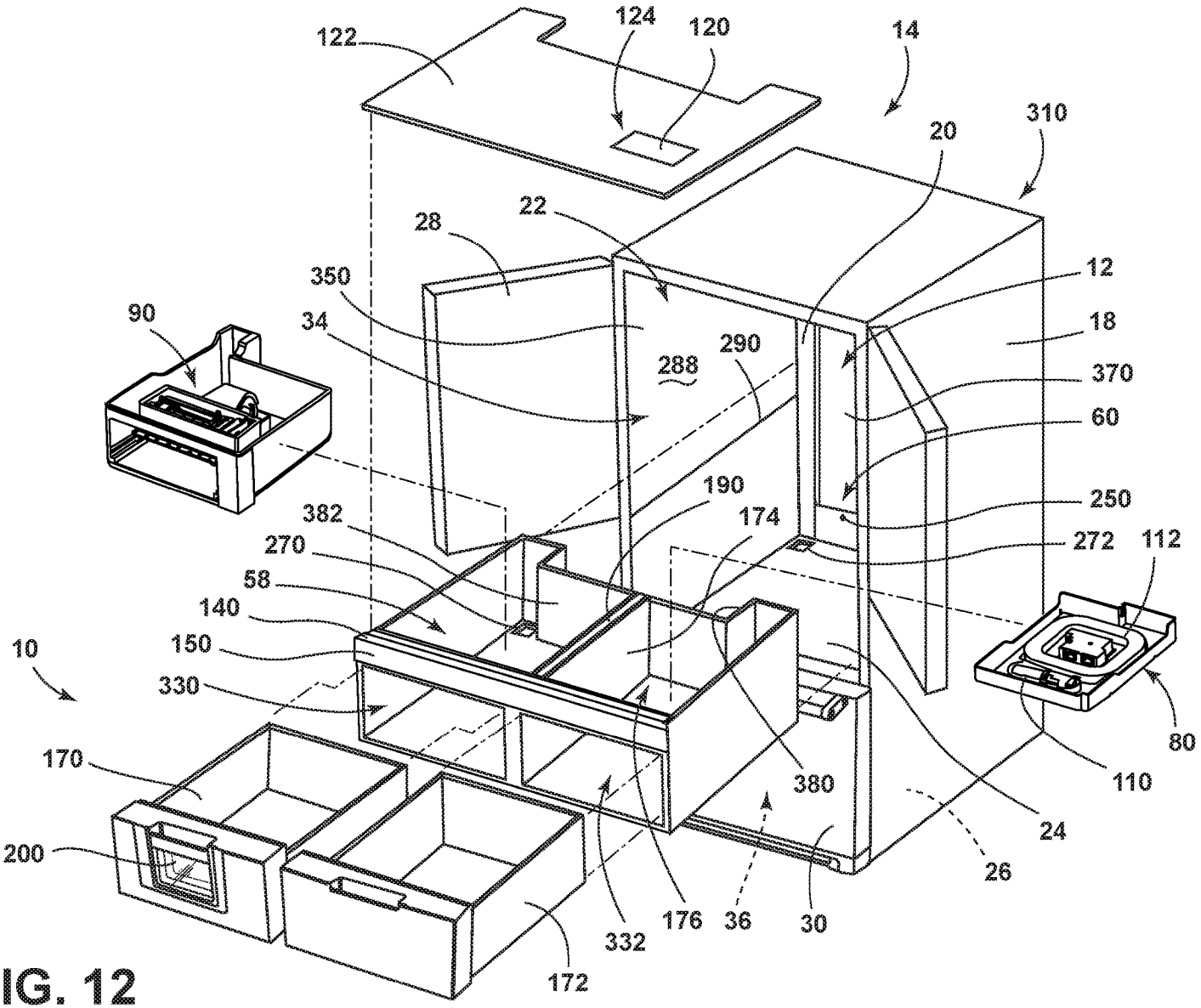
FIG. 12 is an exploded top perspective view of a refrigerating appliance incorporating another embodiment of the insertable pantry box system.
Figure 13:
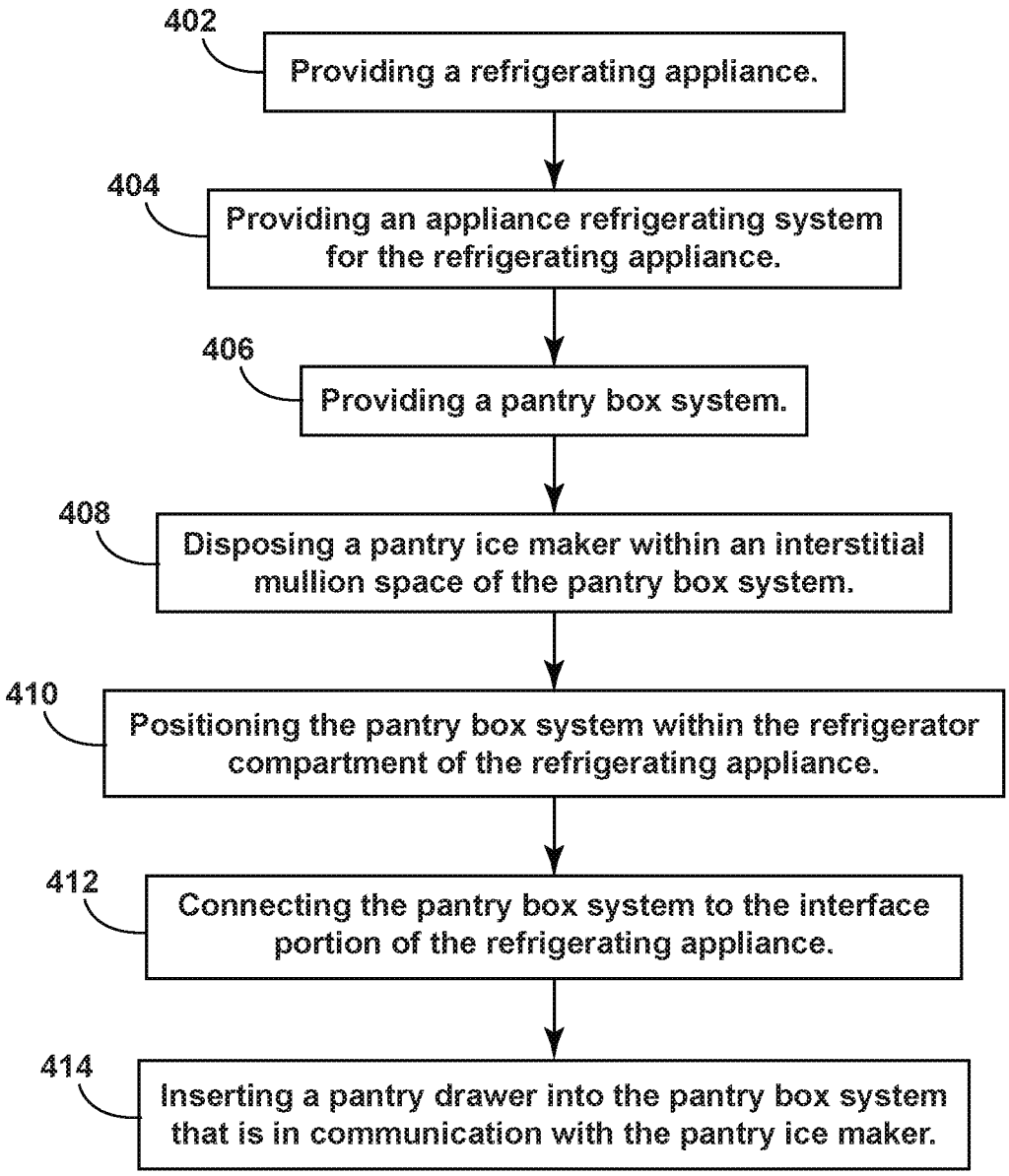
FIG. 13 is a schematic flow diagram illustrating a method for installing a pantry box system into a refrigerating appliance.

Referring now to the embodiment illustrated in FIGS. 10 and 11, the pantry box system 10 can include the pantry mullion, which can correspond to the top mullion 52 discussed above. The pantry mullion includes the interstitial space within. The pantry wall 40 extends perpendicularly from the pantry mullion, and the base 42 is positioned proximate the pantry wall 40 and is substantially parallel with the pantry mullion. In such an embodiment, the pantry mullion, the pantry wall 40 and the base 42 define the insertable pantry compartment 38 having an internal pantry volume 44. It is contemplated that the one or more pantry drawers 46 can be disposed within the insertable pantry compartment 38 so as to be in operable communication with the internal pantry volume 44. The at least one pantry drawer 46 can be operable through a drawer aperture 320 that is defined in the pantry wall 40, where the one or more pantry drawers 46 are operable between the open and closed positions 100, 50. It is also contemplated that the at least one pantry drawer 46 can include the external drawer panel 48 that is configured to conceal the drawer aperture 320 when the at least one pantry drawer 46 is in the closed position 50. Additionally, the pantry box cooling system 56 can be installed within a portion of the insertable pantry compartment 38, wherein the pantry box cooling system 56 is configured to deliver cooling to the insertable pantry compartment 38 from an external location when the insertable pantry compartment 38 is positioned within a refrigerating appliance 14. It is also contemplated that a pantry box cooling system 56 can include a control that independently controls at least one pantry temperature of the internal pantry volume 44 of the insertable pantry compartment 38.

Referring again to the embodiments illustrated in FIGS. 10 and 11, the insertable pantry compartment 38 can include the medial wall 174 that divides the internal pantry volume 44 into first and second pantry compartments 330, 332. In such an embodiment, first and second drawers 170, 172 are slidably engaged with the first and second pantry compartments 330, 332, respectively. Additionally, the medial wall 174 is configured to extend between the pantry mullion and the base 42. According to the various embodiments, the medial wall 174 can include an insulated panel 190 that substantially prevents thermal infiltration between the first and second pantry compartments 330, 332 of the insertable pantry compartment 38.

Referring again to the embodiment illustrated in FIGS. 10 and 11, the first and second pantry compartments 330, 332 are configured to be in communication with the pantry box cooling system 56. In this manner, the first pantry compartment 330 is configured to be maintained at a first compartment temperature, corresponding to the third temperature 58. Additionally, the second pantry compartment 332 can be configured to be maintained at a second compartment temperature, corresponding to the fourth temperature 176, wherein the first and second compartment temperatures are independently adjustable and can define the same or different temperatures. Accordingly, the first pantry compartment 330 can be one of a refrigerator pantry compartment **12*a* or a freezer compartment 26*a*. Simultaneously, the second pantry compartment 332 can also define independent of the first pantry compartment 330 either a separate refrigerator pantry compartment 12*a* or a separate freezer pantry compartment 26*a*, irrespective of the first compartment temperature of the first pantry compartment 330**.

According to the various embodiments, it is contemplated that the at least one or both of the first and second pantry compartments 330, 332 can be placed in communication with a heating mechanism. In such an embodiment, the first and/or second pantry compartments 330, 332 can be configured to be a heating compartment or warmer/thawing compartment disposed within the refrigerating appliance 14. In such an embodiment, the various insulated panels 190 disposed within the pantry box system 10 and the refrigerating appliance 14 serve to prevent thermal transfer between the refrigerator compartment 12, the freezer compartment 26 and the first and second pantry compartments 330, 332 such that the various compartments can define refrigerator or freezer compartment 12, 26 or a heating compartment of the refrigerating appliance 14.

According to the various embodiments, the pantry box system 10 can be installed as a pantry compartment 38 within any one of various appliances. Such appliances can include, but are not limited by, a refrigerating appliance 14, a freezing appliance, a cooler, a warming appliance or other similar temperature-regulating appliance. It is also contemplated that an appliance can include two or more separate pantry box systems 10 disposed therein that define a plurality of pantry compartments 38. It is further contemplated that a particular appliance can be filled with only pantry box systems 10, where all of the various temperature-controlled compartments of the appliance are pantry compartments 38 defined by the various pantry box systems 10 disposed therein.

Referring now to the embodiments illustrated in FIGS. 1-13, having described various embodiments of the pantry box system 10 that is configured to be disposed within a refrigerating appliance 14, a method 400 is disclosed for installing a pantry box system 10 into a refrigerating appliance 14 to create a pantry compartment 38 that is thermally independent. According to the method 400, a refrigerating appliance 14 is provided, where the refrigerating appliance 14 includes a cabinet 16 having a plurality of sidewalls 18 and a rear wall 20 that defines an interior volume 22. It is contemplated that the interior volume 22 can be divided by an interior mullion 24 to further define the refrigerator compartment 12 and the freezer compartment 26 of the refrigerating appliance 14 (step 402). An appliance cooling system is also provided, where the appliance cooling system includes a compressor, condenser, evaporator, expansion device, and a refrigerant (step 404). It is contemplated that the appliance cooling system can be disposed within the cabinet 16 and placed in communication with the refrigerator and freezer compartments 12, 26. The appliance cooling system is also configured to maintain the refrigerator compartment 12 at the first temperature 34 and also maintain the freezer compartment 26 at the second temperature 36. The appliance cooling system is also in communication with an interference portion of the cabinet 16.

Referring again to FIGS. 1-13, according to the method 400, a pantry box system 10 is also provided where the pantry box system 10 includes a pantry wall 40, a base 42 and a pantry top mullion 52 that cooperate to define an insertable pantry compartment 38, and a pantry box cooling system 56 that is in communication with the insertable pantry compartment 38 (step 406). According to the various embodiments, the pantry wall 40 can include a perimetrical pantry wall 40 that extends around the outside of the insertable pantry compartment 38. It is also contemplated that the pantry wall 40 can include one or more exterior walls that extend between a portion of the pantry top mullion 52 and the base 42.

According to various alternate embodiments, the pantry wall 40 can include a series of supports that extend around a perimeter of the pantry box system 10. In such an embodiment, the vertical supports can serve to position the pantry mullion relative to the base 42. When the pantry box system 10 is installed into the cabinet 16 of the refrigerating appliance 14, the surface of the liner 350 defined within the cabinet 16 cooperates with the insertable pantry compartment 38 to define the walls of the first and second pantry compartments 330, 332. Accordingly, the pantry box system 10, in such an embodiment, is not fully enclosed, but serves to cooperate with the liner 350 of the cabinet 16 to define an enclosed internal pantry volume 44 when the pantry box system 10 is installed within the cabinet 16. Similarly, the base 42 and/or the pantry mullion, depending upon the location that the pantry box system 10 is installed within the cabinet 16, can include spaces or gaps that are filled by the bottom or top surface of the interior mullion 24 of the refrigerating appliance 14, depending upon the location of the pantry box system 10.

By way of example, and not limitation, where the pantry box system 10 is disposed within the refrigerator compartment 12 and at least partially resting on the interior mullion 24 of the refrigerating appliance 14, the base 42 of the pantry box system 10 can cooperate with the liner 350 at the top of the interior mullion 24 to fully enclose the internal pantry volume 44 of the pantry box system 10.

Referring again to the embodiments illustrated in FIGS. 1-13, the method 400 includes disposing a pantry ice maker 90 within the interstitial mullion space 54 defined within the pantry mullion (step 408). In such an embodiment, the pantry ice maker 90 is configured to be in communication with a pantry box cooling system 56. In various embodiments, the pantry ice maker 90 can include a dedicated evaporator that is connected to a refrigerant line extending at least partially through the interstitial mullion space 54 and which is in communication with the refrigeration system 32 of the refrigerating appliance 14. It is also contemplated that the pantry ice maker 90 is configured to deliver ice to a portion of the pantry compartment 38. According to the various embodiments, the pantry ice maker 90 can extend at least partially into the first or second pantry compartments 330, 332, where a bottom portion of the pantry ice maker 90 includes a sensing mechanism that determines the amount of ice that has been delivered and currently rests within the first and/or second pantry compartment 330, 332 into which ice has been disposed from the pantry ice maker 90.

Referring again to FIG. 13, according to the method 400, the pantry box system 10 is positioned within the refrigerator compartment 12 (step 410). Accordingly, the insertable pantry compartment 38 can be incorporated within the refrigerator compartment 12. Due to the various insulated panels 190, the pantry compartment 38, while positioned within the interior volume 22 of the refrigerator compartment 12, is thermally independent from the refrigerator compartment 12. It is also contemplated that the pantry box system 10 can be installed within the freezer compartment 26 of the refrigerating appliance 14, wherein the insertable pantry compartment 38 would, in such an embodiment, be defined within, and thermally separate from, the freezer compartment 26 of the refrigerating appliance 14.

After being installed within the refrigerator compartment 12 (or freezer compartment 26), the pantry box system 10 is connected to the interface portion 60 of the cabinet 16, such that the pantry box cooling system 56 is placed in communication with the appliance cooling system (step 412). Accordingly, the pantry box cooling system 56 can be configured to maintain the first pantry compartment 330 at the third temperature 58 and the second pantry compartment 332 at the fourth temperature 176. As discussed earlier herein, it is contemplated that the first, second, third and fourth temperatures 34, 36, 58, 176 of the refrigerating appliance 14 can be separately and independently modified relative to one another.

Referring again to the embodiments illustrated in FIGS. 1-10, at least one pantry drawer 46, such as a first and second drawer 170, 172, can be inserted into an aperture defined within the insertable pantry compartment 38. Due to the presence of the medial wall 174 extending through the pantry box system 10, the insertable pantry compartment 38 can include first and second apertures 360, 362 for receiving the first drawer 170 within the first pantry compartment 330, and the second drawer 172 within the second pantry compartment 332, respectively (step 414).

According to the various embodiments, when the first and second drawers 170, 172 are inserted within the first and second apertures 360, 362 defined within the insertable pantry compartment 38, the exterior drawer panels of the first and second drawers 170, 172 serve to conceal at least a portion of the pantry compartment 38 and also cover at least a portion of the refrigerator compartment 12 when the first and/or second drawers 170, 172 are in the closed position 50. As discussed above, when the pantry box system 10 is installed within the refrigerator compartment 12 of the refrigerating appliance 14, additional systems of the pantry box system 10 can be connected with various systems of the refrigerating appliance 14. Such systems can include, but are not limited to, the pantry water system 80 being connected to the appliance water system 82, the pantry box cooling system 56 being connected to the appliance refrigeration system 32, the pantry electrical system being connected to the appliance electrical system and other similar connected pantry/appliance systems. As discussed above, it is contemplated that at least a portion of these systems can be connected by hand and without the use of tools or by inserting the pantry box system 10 into the installed position 242 within the cabinet 16 of the refrigerating appliance 14. Additionally, the guide surfaces 290 defined within the inside surface of the liner 350 of the cabinet 16 can serve to guide the pantry box interface 240 into connection with the interface portion 60 of the refrigerating appliance 14 such that the installed position 242 of the pantry box system 10 defines the connection between the various systems of the pantry box system 10 and the refrigerating appliance 14. Alternatively, certain utility systems of the pantry box system 10 can be connected to the corresponding systems of the refrigerating appliance 14 by the use of tools for tightening, adhering, welding or performing some other connection method.

According to the various embodiments, the interface portion 60 of the cabinet 16 can be defined within a rear portion 368 of the refrigerating appliance 14 such as in the cooling tower 370 or similar structure defined within the refrigerator compartment 12. In such an embodiment, the cooling tower 370 can include various mechanical interfaces that define the interface portion 60 of the refrigerating appliance 14. Similarly, a corresponding portion of the pantry box interface 240 of the pantry box system 10 can engage a portion of the cooling tower 370 to place the pantry box interface 240 in communication with the interface portion 60 of the refrigerating appliance 14. It is also contemplated that the interface portion 60 of the refrigerating appliance 14 can be in portions distal from the back wall of the refrigerating appliance 14, such as in a sidewall 18 of the liner 350, within a portion of the internal mullion, or other similar position. It is contemplated that whatever the position of the interface portion 60 of the refrigerating appliance 14, it is a position that is substantially engaged by the pantry box system 10 when the pantry box system 10 is placed in the installed position 242 within the refrigerating appliance 14.

Referring again to the embodiment illustrated in FIG. 9, the pantry box system 10 can include a recess portion 380 that cooperates with the geometry of the cooling tower 370 disposed within the backwall 382 of the refrigerator compartment 12. Accordingly, the pantry wall 40 of the pantry box system 10 can matingly engage the backwall 382 of the refrigerator compartment 12. It is contemplated that the mating engagement with the pantry wall 40 and the various geometries of the refrigerator compartment 12 can serve to further locate the pantry box system 10 within the refrigerator compartment 12 to further align the pantry box interface 240 with the interface portion 60.

The invention claimed is:

1. A refrigerating appliance comprising:

a cabinet having an interior volume, wherein an interior mullion extends through the interior volume to define refrigerator and freezer compartments within the interior volume;

a refrigeration system that operates to maintain the refrigerator and freezer compartments at first and second temperatures, respectively, the refrigeration system having an interface portion defined within the cabinet;

an appliance water system disposed within the cabinet, wherein a portion of the appliance water system extends to the interface portion of the cabinet; and a pantry box system having a pantry compartment and disposed within the refrigerator compartment, the pantry box system comprising:

at least one pantry drawer, wherein each pantry drawer is operable between open and closed positions and includes an exterior drawer panel that conceals at least a portion of the pantry compartment and covers a portion of the refrigerator compartment when each pantry drawer is in the closed position;

a top mullion having a bottom panel that defines a lower boundary of an interstitial mullion space of the top mullion and a top boundary of the pantry compartment;

a pantry water system at least partially disposed within the interstitial mullion space, wherein a portion of the pantry water system is disposed on top of the bottom panel of the top mullion, wherein engagement of the pantry box system with the interface portion places the pantry water system in communication with the appliance water system, wherein a water filter and water tank are disposed within the interstitial mullion space, wherein the water filter and water tank are in communication with the pantry water system, and wherein the water filtere is selectively removable from the interstitial mullion space through an operable access panel defined within a wall of the top mullion, and a pantry box cooling system that provides cooled air to the pantry compartment from at least one of the refrigerator compartment, the freezer compartment and the refrigeration system, wherein the pantry box cooling system is configured to maintain the pantry compartment at a third temperature, wherein the pantry box cooling system engages the interface portion to communicate with the refrigeration system.

2. The refrigerating appliance of claim 1, wherein the at least one pantry drawer includes first and second drawers that are selectively and independently operable between the open and closed positions.

3. The refrigerating appliance of claime 1, wherein a pantry ice maker is disposed at least partially within the interstitial mullion space, wherein the pantry ice maker is in communication with the pantry water system, and wherein the pantry ice maker is also in communication with an ice bin disposed within the at least one pantry drawer when the at least one pantry drawer is in the closed position, such that the pantry ice maker delivers formed ice to the ice bin.

4. The refrigerating appliance of claim 2, wherein the first and second drawers are separated by a medial wall that extends between the interior mullion and the bottom panel.

5. The refrigerating appliance of claim 4, wherein first and second drawers are in communication with the pantry box cooling system wherein the first drawer is maintained at the third temperature and the second drawer is maintained at a fourth temperature, wherein the first, second, third and fourth temperatures are independently adjustable to define a plurality of temperatures.

6. The refrigerating appliance of claim 4, wherein the at least one pantry drawer includes first and second drawers, and wherein the first drawer includes the ice bin, wherein the ice bin includes first and second ice compartments that are independently and selectively removable from the first drawer, and wherein the first drawer includes a viewing window disposed within the exterior drawer panel that allows the ice bin to be viewed from an exterior of the cabinet when the first drawer is in the closed position.

7. A pantry box system for installation in a compartment of an appliance, the pantry box system comprising:

a pantry mullion having a bottom panel that at least partially defines an interstitial space defined within the pantry mullion, wherein the interstitial space within the pantry mullion includes a pantry water system positioned above the bottom panel;

a pantry wall extending perpendicularly from the pantry mullion, wherein the pantry mullion and the pantry wall define an insertable pantry compartment having an internal pantry volume;

at least one pantry drawer in operable communication with the internal pantry volume, the at least one pantry drawer operable through a drawer aperture defined in the pantry wall between open and closed positions, wherein each at least one pantry drawer includes an exterior drawer panel that conceals the drawer aperture when the at least one pantry drawer is in the closed position, wherein a pantry ice maker is disposed at least partially within the interstitialspace, wherein the pantry ice maker is in communication with the pantry water system, and wherein the pantry ice maker is also in communication with an ice bin disposed within the at least one pantry drawer when the at least one pantry drawer is in the closed position, such that the pantry ice maker delivers former ice to the ice bin;

a pantry box cooling system that is configured to deliver cooling to the insertable pantry compartment from an external location when the insertable pantry compartment is positioned within the appliance; and a pantry box interface that is configured to engage the appliance wherein the pantry box cooling system is in communication with the pantry box interface, wherein the pantry water system is at least partially disposed within the interstitial space and is in communication with the pantry box interface, and wherein the pantry box interface is positioned on a portion of the insertable pantry compartment.

8. The pantry box system of claim 7, wherein the insertable pantry compartment includes a medial wall that divides the internal pantry volume into first and second pantry compartments, wherein the at least one pantry drawer includes first and second drawers that are slidably engaged with the first and second pantry compartments, respectively, and wherein the medial wall extends between the pantry mullion and a base, the base being substantially parallel with the pantry mullion.

9. The pantry box system of claim 7, wherein a water filter is disposed within the interstitial space and is in communication with the pantry water system, wherein the water filter and water tank are in communication with the pantry water system and an appliance water system, and wherein the water filter is selectively removable from the interstitial space through an operable access panel defined within a wall of the pantry mullion.

10. The pantry box system of claim 8, wherein first and second pantry compartments are in communication with the pantry box cooling system wherein the first pantry compartment is configured to be maintained at a first compartment temperature, and wherein the second pantry compartment is configured to be maintained at a second compartment temperature, wherein the first and second compartment temperatures are independently adjustable.

11. The pantry box system of claim 7, wherein the at least one pantry drawer includes first and second drawers, and wherein the first drawer includes the ice bin, wherein the ice bin includes first and second ice compartments that are independently and selectively removable from the first drawer, and wherein the first drawer includes a viewing window disposed within the exterior drawer panel that allows the ice bin to be viewed from an exterior of an appliance cabinet when the first drawer is in the closed position.

12. The pantry box system of claim 7, wherein the pantry box cooling system includes a control that independently controls at least one pantry temperature of the internal pantry volume of the insertable pantry compartment.

* * * * *